US006795676B2

(12) United States Patent
Kikuchi et al.

(10) Patent No.: US 6,795,676 B2
(45) Date of Patent: Sep. 21, 2004

(54) SHEET WRAPPING AVOIDABLE FIXING APPARATUS AND IMAGE FORMING APPARATUS

(75) Inventors: Hisashi Kikuchi, Kanagawa-ken (JP); Shigeo Kurotaka, Kanagawa-ken (JP); Kiyoshi Ohshima, Kanagawa-ken (JP); Takashi Fujita, Tokyo-to (JP); Toshihiko Baba, Chiba-ken (JP); Atsushi Nakafuji, Kanagawa-ken (JP); Hirokazu Ikenoue, Tokyo-to (JP); Jun Yura, Kanagawa-ken (JP); Echigo Katsuhiro, Saitama-ken (JP); Hideki Kosugi, Kanagawa-ken (JP)

(73) Assignee: Ricoh Company, LTD, Tokyo (JP)

( * ) Notice: Subject to any disclaimer, the term of this patent is extended or adjusted under 35 U.S.C. 154(b) by 0 days.

(21) Appl. No.: 10/158,852

(22) Filed: Jun. 3, 2002

(65) Prior Publication Data

US 2003/0016971 A1 Jan. 23, 2003

(30) Foreign Application Priority Data

Jun. 1, 2001 (JP) ..... 2001-167346
Jul. 23, 2001 (JP) ..... 2001-222186
Aug. 30, 2001 (JP) ..... 2001-261814

(51) Int. Cl.[7] ..... G03G 15/20
(52) U.S. Cl. ..... 399/323; 399/328
(58) Field of Search ..... 399/320, 322, 399/323, 328, 329; 219/216; 271/301, 308, 310, 311, 900

(56) References Cited

U.S. PATENT DOCUMENTS 5,671,471 A * 9/1997 Mizuno et al. ..... 399/297
5,802,434 A * 9/1998 Takehara et al. ..... 399/323
5,923,930 A 7/1999 Tsukamoto et al. ..... 399/237
6,055,390 A 4/2000 Kurotaka et al. ..... 399/69
6,078,766 A 6/2000 Kurotaka ..... 399/165
6,088,558 A 7/2000 Yamada et al. ..... 399/165
6,108,906 A 8/2000 Fujita et al. ..... 29/895.211
6,115,576 A 9/2000 Nakano et al. ..... 399/302
6,122,479 A 9/2000 Fujita et al. ..... 399/333
6,198,888 B1 3/2001 Kurotaka et al. ..... 399/69
6,243,559 B1 6/2001 Kurotaka et al. ..... 399/329
6,262,787 B1 7/2001 Kamoi et al. ..... 349/96
6,295,435 B1 9/2001 Shinohara et al. ..... 399/301
6,347,212 B1 2/2002 Kosugi et al. ..... 399/348
6,366,751 B1 4/2002 Shakuto et al. ..... 399/159

FOREIGN PATENT DOCUMENTS

JP 08-146806 6/1996
JP 8-314305 11/1996

(List continued on next page.)

*Primary Examiner*—Hoan Tran
(74) *Attorney, Agent, or Firm*—Oblon, Spivak, McClelland, Maier & Neustadt, P.C.

(57) ABSTRACT

A fixing apparatus includes a fixing member to be heated and a pressure-contacting member for pressure contacting the fixing member. The fixing apparatus directs and conveys a recording member through a nip formed between the fixing member and pressure applying member in such a manner that a toner image carried on a recording member contacts the fixing member in order to be fixed thereto with heat and pressure. The fixing apparatus is configured to direct a tip margin of the recording member toward the pressure applying member across a virtual linear extension line drawn from a downstream end to upstream end of the nip when only the tip margin exits from the nip. A fixing member side separation device may be separately provided from the surface of the fixing apparatus so as to separate the recording member exiting from the nip. A gap formed between the downstream end of the nip and the tip of the fixing member side separation device is set smaller than the width of the tip margin.

31 Claims, 15 Drawing Sheets

FOREIGN PATENT DOCUMENTS

| | | |
|---|---|---|
| JP | 09-22210 | 1/1997 |
| JP | 10/274894 | 10/1998 |
| JP | 10/307496 | 11/1998 |
| JP | 284885 | 1/1999 |
| JP | 11/38807 | 2/1999 |
| JP | 2000-98791 | 4/2000 |
| JP | 2001-6849 | 1/2001 |
| JP | 2001-83832 | 3/2001 |
| JP | 2001/215825 | 8/2001 |
| WO | WO 99/17168 | 4/1999 |

* cited by examiner

SHEET WRAPPING AVOIDABLE FIXING APPARATUS AND IMAGE FORMING APPARATUS

CROSS-REFERENCE TO RELATED APPLICATIONS

This application claims priority under 35 USC § 119 to Japanese Patent Application Nos. 2001-222186, 2001-167346, and 2001-261814 filed on Jul. 23, 2001, Jun. 1, 2001, Aug. 30, 2001, respectively, the entire contents of which are herein incorporated by reference.

BACKGROUND OF THE INVENTION

1 Field of the Invention

The present invention relates to a fixing apparatus and an image forming apparatus including a heat fixing member and a pressure applying member pressure contacting the fixing member.

In particular, the present invention relates to a fixing apparatus and image forming apparatus capable of fixing a toner image to a recording member while directing and conveying the recording member to and through a nip formed between the fixing member and pressure applying member in such a manner that the toner image contacts the fixing member.

2. Discussion of the Background

It has been well known that a fixing apparatus of the above-described type is adopted in an image forming apparatus, such as a copier, a printer, a facsimile, a combined machine having at least one of them, and etc. In such a type of the fixing apparatus, since the toner fuses when passing the nip formed between the fixing and pressure applying members, the toner likely functions as adhesive agent and the recording member ejected from the nip is not separated and wraps around the surface of the fixing member. In particular, in an image forming apparatus farming a full-color image, since different color toner images are superimposed on a recording member and fixed by a fixing apparatus, a plenty of toner necessarily fuses in the nip, and thus adhesive force of the toner increases. As a result, the recording member more readily wraps around the fixing member.

Then, in the past, a separation member including a plurality of separation claws is configured to contact a surface of a fixing member and separate a recording member ejected from a nip from the surface of the fixing member in order for the recording member not to wrap around the surface of the fixing member. However, since the separation claw contacts the surface of the fixing member via its tip, the surface likely is cut (e.g, damaged). As a result, a mark appears on a toner image after passing through the nip in accordance with the cut, and resulting in inferior toner image quality as a result of fixing.

To remove such a disadvantage, a fixing apparatus is proposed to arrange a separation claw separating from a surface of the fixing member. However, a recording member ejected from the nip likely enters into a gap formed between the fixing member and separation claw while sticking the surface of the fixing member. As a result, a separation function of the recording member is weakened and wrapping likelihood of the recording member around the fixing member increases.

In addition, there exists a case when a fixed toner image is formed on a backside surface of the recording member carrying a toner image on the other side to be fixed. In such a situation, since the toner image on the backside surface is fused by heat while passing through the nip, the recording member likely wraps around the surface of the pressure applying member. To avoid such a problem, a separation claw preferably contacts the surface of the pressure applying member. However, a similar problem arises as described in the above.

SUMMARY OF THE INVENTION

The present invention has been made in view of such problems and to address and resolve such problems. Accordingly, it is an object of the present invention to provide a novel fixing apparatus including a fixing member and a pressure applying member configured to pressure contact the fixing member. The fixing apparatus directs and conveys a recording member through a nip formed between the fixing member and pressure applying member so that a toner image carried on the recording member can contact the fixing member to be fixed thereto with heat and pressure. The fixing apparatus is configured to direct a margin formed in a transfer direction tip of the recording member across a virtual linear extension line drawn from a downstream end to an upstream end both in the nip toward the pressure applying member, when only the margin exits from the nip. A fixing member side separation device is provided so as to separate the recording member ejected from the nip not contacting the surface of the fixing apparatus. In addition, a gap between the downstream end of the nip and the tip of the fixing member side separation device is set smaller than the width of the margin of the downstream end.

In yet another embodiment, a JIS-A(Asker-C) hardness of the surface of the pressure applying member of the nip at the downstream end may be larger than that of the downstream end of the fixing member.

In another embodiment, a pressure applying member side separation device is provided with its tip contacting the surface of the pressure applying member.

In yet another embodiment, a JIS-A hardness of the surface of the fixing member in the nip in the downstream end is substantially the same to that of the downstream end of the surface of the pressure applying member.

In yet another embodiment, a JIS-A hardness of the surface of the fixing member of the nip in the downstream end is higher than that of the downstream end of the pressure applying member.

In yet another embodiment, a fixing member side separation device is provided with its tip contacting the surface of the fixing member.

In yet another embodiment, gap maintaining members are provided on respective tips of the fixing member side separation devices disposed in a direction perpendicular to the transfer direction so as to contact the surface of a non-transfer member passage area of the fixing member so that a gap formed between the tip of the fixing member side separation device and the surface of the fixing member is maintained.

In yet another embodiment, gap maintaining members are also provided on respective tips of the pressure applying member side separation devices so as to contact the surface of a non-transfer member passage area of the pressure applying member so that a gap formed between the tip of the pressure applying member side separation device and the surface of the pressure applying member is maintained.

In yet another embodiment, the fixing member side separation device is a single separation member type.

In yet another embodiment, the pressure applying member side separation device is a single separation member type.

In yet another embodiment, the fixing member side separation device includes an opening for ventilation.

In yet another embodiment; the pressure applying member side separation device includes an opening for ventilation.

In yet another embodiment, the fixing member side separation device is formed from a sheet like separation member, and is biased by a tension applying member in a direction perpendicular to the transfer direction.

In yet another embodiment, the pressure applying member side separation device is formed from a sheet like separation member, and is biased be a tension applying member in a direction perpendicular to the transfer direction.

In yet another embodiment, toner includes, at least, plastic, colorant, and wax.

BRIEF DESCRIPTION OF THE DRAWINGS

A more complete appreciation of the present invention and many of the attendant advantages, thereof will be readily obtained as the same becomes better understood by the following detailed description when considered in connection with the accompanying drawings, wherein.

DESCRIPTION OF THE PREFERRED EMBODIMENTS

Figure 1:
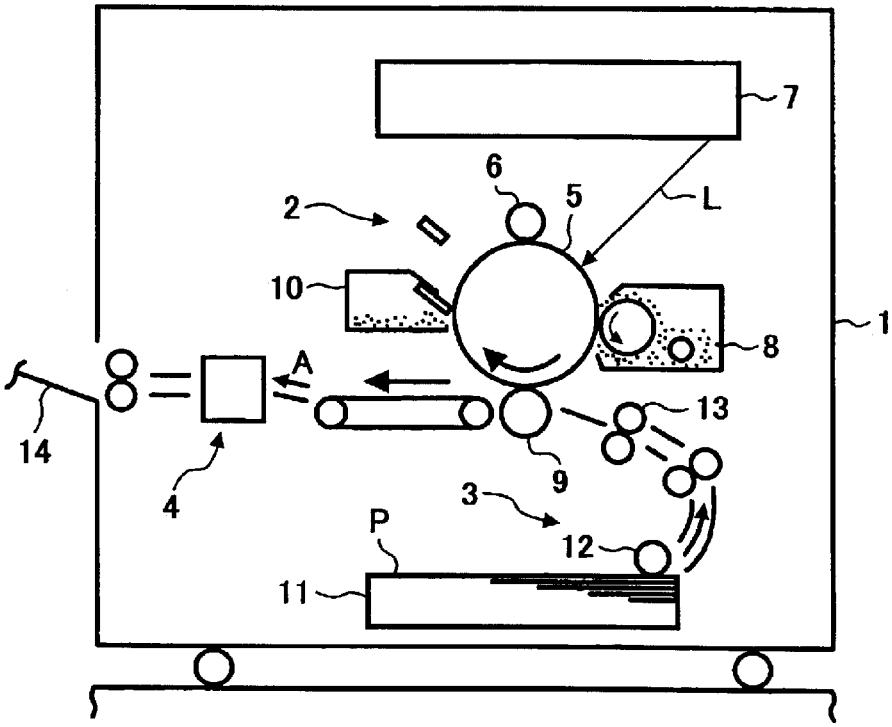
FIG. 1 is a schematic cross sectional diagram for illustrating one example of an image forming apparatus.

Referring now to the drawings, wherein like reference numerals and marks designate identical or corresponding parts throughout several views, in particular, in FIG. 1, a schematic image forming apparatus 1 is illustrated using a vertical cross sectional view. The image forming apparatus 1 may include an image formation member 2 for forming a toner image on a recording member, a sheet feeding device 3 for feeding recording members to the image formation member 2, and a fixing apparatus 4 for fixing a toner image formed on the recording member. An exemplary configuration of the fixing apparatus 4 simply illustrated by a block may be described later in detail. The image formation device 2 may include a drum shaped photo-conductive member 5 serving as one example of an image carrier, and the surface of the PC member 5 is charged in a prescribed polarity while rotating clockwise. To the charged surface, a laser beam "L" ejected from a laser writing unit 7 serving as one example of an exposure apparatus may be modulated and irradiated. Thereby, a latent image may be formed on the PC member surface. The latent image may then be visualized by the developing apparatus 8 to be a toner image. The toner image may then be transferred by a transfer apparatus 9 onto a recording member transferred from the sheet feeding apparatus 3. A cleaning apparatus 10 may remove remaining and sticking toner on the PC drum surface after the toner image transfer.

Figure 2:
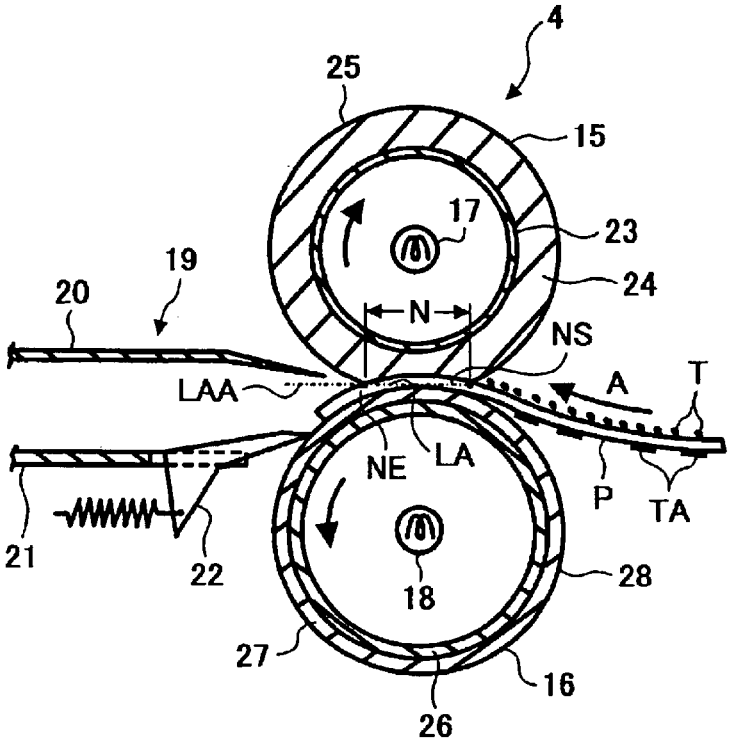
FIG. 2 is a cross sectional view for illustrating one example of a fixing apparatus.

The sheet-feeding device 3 may include a cassette 11 containing recording members P such as transfer sheets, plastic sheets, etc. The recording members P may be fed from the cassette 11 from the upper most one by rotation of a feeding roller 12. The recording member may then be fed to a transfer station formed between the PC member 5 and transfer apparatus 9. Then, the toner image on the PC member 5 may be transferred onto recording member as described above. Thus, the recording member carrying the toner image in such a manner may then be transferred through the fixing apparatus 4 as illustrated by an arrow "A", and passes therethrough. At that time, the toner image on the recording member may be fixed. The recording-member passing through the fixing apparatus 4 may then be ejected on a tray 14 outside the image forming apparatus. FIG. 2 is an enlarged cross sectional view illustrating one example of a fixing apparatus 4. The fixing apparatus 4 may include a fixing roller 15 as a fixing member, and a pressure roller a pressure 16 pressure contacting the fixing roller 15 as a pressure applying member. A nip "N" may be formed due to pressure contact of these rollers 15 and 16. The fixing roller 15 and pressure roller 16 may each be formed in a cylindrical shape having a cross section having circular outer circumference. In an illustrated example, these rollers 15 and 16 may each be formed in a hollow cylindrical shape. The fixing roller 15 may rotate clockwise, and the pressure roller 16 may rotate counterclockwise.

The nip N formed between these rollers 15 and 16 may be controlled by a heating device to maintain an appropriate temperature for fixing a toner image. In the example, halogen heaters 17 and 18 may be disposed inside the fixing and pressure rollers 15 and 16 as heat sources, respectively. These heaters 17 and 18 may be controlled by a temperature control device (not shown) to turn ON/OFF in order to maintain the appropriate temperature.

The recording member "P" carrying a not yet fused toner image "T" may be conveyed to the fixing apparatus 4 in a direction illustrated by an arrow "A". The recording member "P" may pass through the nip "N" while directing the toner image "T" to the surface of the fixing roller 15.

Thereby, the toner image "T" on the recording member "P" may be fixed thereonto by the heat and pressure.

A basic configuration employed in the below described various examples will be substantially the same to that described above. Instead of using the above-described configuration of rollers 15 and 16 of FIG. 2, the fixing member can be formed by a rotating seamless fixing belt wound and driven by a guide member as described later. The pressure applying member can also be a seamless pressure belt wound and driven by a guide member. In such a manner, these fixing and pressure applying members can be various conformations.

Now, when a toner image "T" carried on the recording member "P" passes through the nip "N" of the fixing apparatus 4 illustrated in FIG. 2, the toner may fuse therein. To avoid the recording member "P" ejected from the nip "N" from wrapping around the surface of the fixing roller 15 due to adhesive force of the toner, the below described configuration may be adopted.

Figure 3:
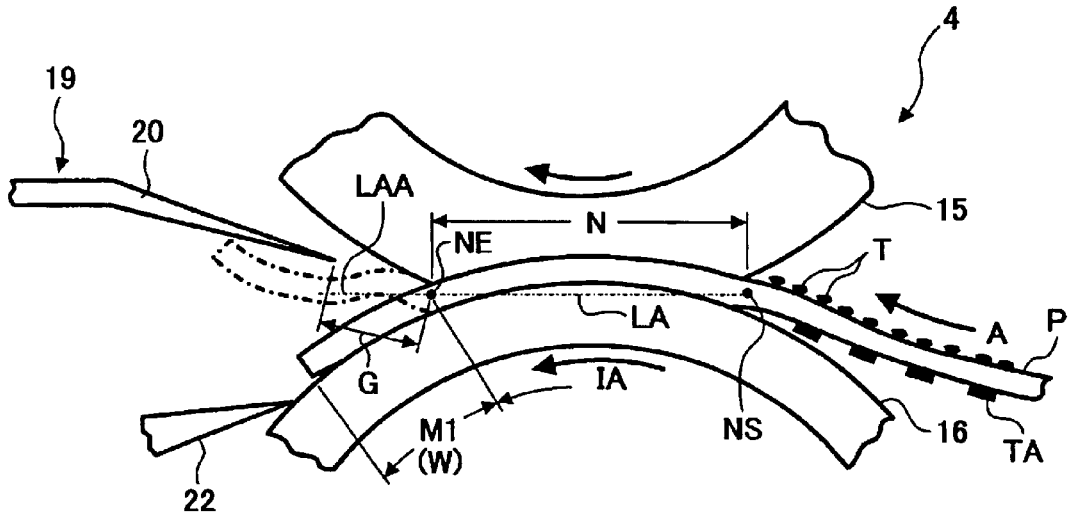
FIG. 3 is an enlarged view for illustrating the fixing apparatus illustrated in FIG. 2.

FIG. 3 is an enlarged explanatory chart illustrating a nip "N" formed between the fixing and pressure rollers 15 and 16, and a recording member "P" passing therethrough. As illustrated in FIGS. 2 and 3, a fixing member side separation device 19 for separating a recording member "P" ejected from the nip "N" from the fixing member (e.g. the fixing roller 15 in this example) may be arranged in the vicinity of an outlet of the nip "N" while being separated from the surface of the fixing member. Such a fixing member side separation device 19 may be shaped in appropriate, such as a sheet state separation member 20.

Figure 4:
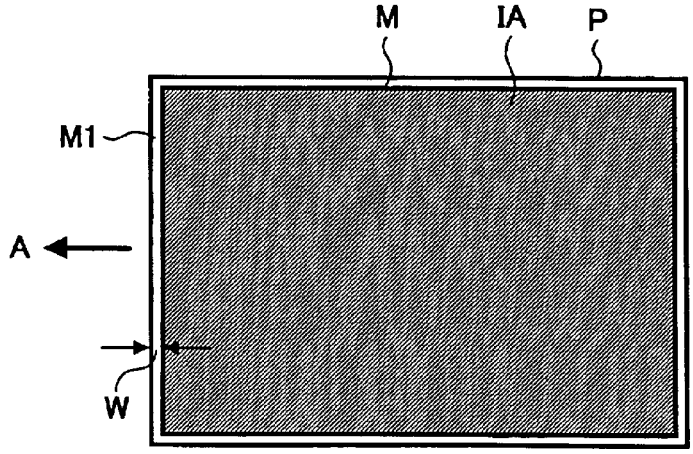
FIG. 4 is an explanatory chart for illustrating a margin on a recording member.

A toner image may be formed on an image region, slashed and having a note "IA", of the recording member as illustrated in FIG. 4. A margin "M" where no toner image is formed may appear in a portion outside the image region "IA". The recording member "P" may be transferred in a direction shown by an arrow "A" and invade the fixing apparatus 4. A width of a blank "M1" located in a tip in the transfer direction "A" is supposed to be "W" ranging from about 2 mm to about 5 mm. FIGS. 2 and 3, and also FIGS. 5 to 10, illustrate a condition where only the tip blank "M1" is just ejected from the nip "N". Now, if a gap formed between an outlet end of the nip N (i.e., a downstream end NE) and a tip, facing the fixing member, of the fixing member separation device 19 is supposed to be "G" as illustrated in FIG. 3, the gap G maybe set smaller in size than the width "W". Accordingly, when only the entire margin M1 of the tip of the recording member P exits from the nip N as illustrated in FIGS. 2 and 3, the tip of the fixing member side separation device 19 may enter and position at a space formed between the margin M1 and fixing roller 15.

A JIS-A (Japanese Industrial Standard-A) (Asker-C) hardness of the surface of the pressure roller 16 may be set higher than that of the surface of the fixing roller 15, and is preferably twenty to forty times thereof. In such a manner, by setting a surface hardness of these rollers 15 and 16, the pressure roller 16 may break into and deform the surface of the fixing roller 15 side the surface by pressure as illustrated in FIGS. 2 and 3. Specifically, a section of the fixing roller 15 pressure contacting the pressure roller 16 may elastically be deformed in a compression condition.

Accordingly, as illustrated in FIGS. 2 and 3, when only the margin M1 exits from the nip "N", the margin "M1" may take a posture along with the surface of the pressure roller 16, and is largely deviated from the surface of the fixing roller 15. Since no toner image is formed in the tip margin M1, the margin M1 may not tend to stick to the surface of the fixing roller 15 due to a toner sticking force. In addition, the margin M1 may be ejected from the nip "N" almost in parallel to the surface of the pressure roller 16. Simultaneously, since the margin M1 is largely distanced from the surface of the fixing roller 15, the margin M1 of the recording member P may not wrap around the surface of the fixing roller 15. If a straight line virtually drown from the downstream end NE to upstream end NS is supposed to be "LA", and when only the tip margin M1 exits from the nip "N", the margin M1 is directed to the pressure applying member (the pressure roller 16 in this example) across the elongation LA extended from the straight line LA.

When the recording member P is further transferred in FIGS. 2 and 3, the image region IA illustrated in FIG. 4 may start to be ejected from the nip N. Then, since the recording member P sticks or tend to stick to the surface of the fixing roller 15 due to an adhesive force of the toner on the image region IA, the recording member P is strained to the fixing roller 15 side. Such a tendency may be prominent when a flexible recording member such as a thin paper is utilized.

However, since the fixing member side separation device 19 is disposed in the vicinity of the fixing roller 15 the recording member P may collide and is then guided by the fixing member side separation device 19 as illustrated in FIG. 3 by a dotted line, and thus is prevented from wrapping around the surface of fixing roller 15. Even if the fixing member side separation device 19 is arranged being separated from the surface of the fixing roller 15, since the gap G is set as smaller than the width W of the margin M1, the recording member P strained toward the fixing roller 15 may be prevented from passing through the gap G and wrapping around the surface of the fixing roller 15. The recording member P exiting from the nip N may subsequently is guided and transferred by the fixing member side separation device 19 located upside and guiding member 21 located downside.

Thus, since the recording member P ejected from the nip N is prevented from wrapping around the surface of the fixing roller 15, and the fixing member side separation device 19 does not contact the surface of the fixing roller 15, a problem that the surface of the fixing roller 15, which has a low hardness and is easily damaged by the fixing member side separation device 19, may be blocked.

The image forming apparatus of FIG. 1 is configured to form a mono color toner image, typically, a black toner image on the recording member P. However, since for example, yellow, magenta, cyan, and black toner images are superimposed on the recording member, and are fixed by a fixing apparatus in an image forming apparatus, the recording member readily particularly wraps around the fixing member. However, by also applying the above-described configuration in the color image forming apparatus, the recording member may avoid from wrapping around the fixing member while the fixing member is prevented from being damaged.

Now, a specific construction of the fixing apparatus 4 is described with reference to FIG. 2. The fixing roller 15 may include a core metal bar 23, an elastic layer 24 laminated on the outer circumferential surface of the core metal 23, and a release agent layer 25 on the outer circumferential surface of the elastic layer 24. The outer diameter of the fixing roller 15 may be 40 mm, for example. The core metal 23 may include an iron hollow roller having an outer diameter of 34 mm and a thickness of 1 mm, for example. The elastic layer 24 may be made of silicon rubber, for example, whose thickness is 3 mm. The release agent layer 25 may be formed by a PFA tube having a thickness of from 10 to 30 $\mu$m. By employing such a release agent layer 25, adhesion of a recording member P to the surface of the fixing roller due to toner adhesive force can be avoided. The pressure roller 16 may include a core metal bar 26 formed by an iron hollow roller having an outer diameter of 38 mm and a thickness of 1 mm, an elastic layer 27 laminated on the outer circumferential surface of the core metal 26, and a release agent layer 28 on the outer circumferential surface of the elastic layer 27. The elastic layer 27 may be made of silicon rubber, for example, whose thickness is 1 mm. The release agent layer 28 may be formed by a PFA tube having a thickness of from 10 to 30 $\mu$m.

Respective surface hardness of the fixing roller 15 and pressure roller 16 may be set to 45 and 80 degrees (i.e. Hs: hardness spring) by the Japanese Industrial Standard JIS-A. In such a manner, since the pressure roller 16 is harder, the fixing roller 15 may be elastically deformed while the pressure roller 16 breaks into the surface of the fixing roller 15. Simultaneously, a nip "N" may be formed along an outer shape of the pressure roller 16.

Figure 5:
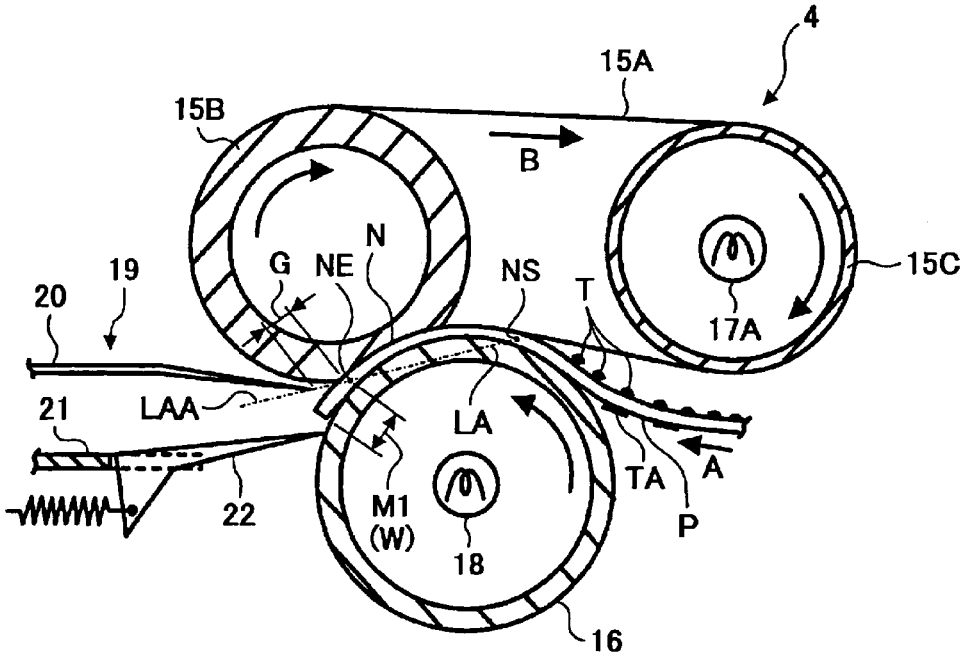
FIG. 5 is a cross sectional view for illustrating another fixing apparatus.

In the fixing apparatus 4 of FIG. 5, a fixing member may be formed from a fixing belt 15A. The fixing belt 15A may be wound around a guide member including a pair of guide rollers 15B and 15C. However, a number of the guide members can be more than three. Further, similar to the illustration of the fixing apparatus of FIG. 2, the pressure applying member may include a hollow pressure roller 16. The pressure roller 16 and guide rollers 15B and 15C may be cylindrical like having cross sections having circular outer circumferences. In the example of FIG. 5, respective rollers 15B, 15C, and 16 may be formed in hollow cylindrical shapes. The pressure roller 16 may pressure contact one of the guide rollers 15B via the fixing belt 15A. Accordingly, the outer peripheral surface of the pressure roller 16 may pressure contact the outer circumferential surface of the fixing belt 15A while forming a nip "N". Respective guide rollers 15B and 15C and pressure roller 16 may rotate in directions shown by arrows, and thereby, the fixing belt 15A may be rotated in the direction shown by an arrow B. Thus, when the seamless fixing belt 15A is rotated, the guide rollers 15B and 15C may function of guiding the seamless fixing belt 15A. In addition, the guide roller 15B opposing to the pressure roller 16 may farm the nip "N" in cooperation with the pressure roller 16. The other guide roller 15C may function as a tension roller far applying tension to the fixing belt 15A. As described later, a guide member other than the guide roller can be employed and the fixing belt 15A can be wound around the other guide member. Otherwise, the pressure roller 16 can pressure contact a plurality of guide members via the fixing belt 15A. Specifically, the fixing member is constituted by the seamless fixing belt wound and rotated by a plurality of guide members, and the pressure applying member is formed from a pressure roller pressure contacting and rotated by the at least one guide members via the fixing belt.

By recognizing the importance of the above-described functions of both guide rollers 15B and 15C, one side guide roller 15B will be termed by an opposing roller, and another guide roller 15C will be termed by a tension roller when required in the below described description.

Further, in the respective tension roller 15C and pressure roller 16 of the fixing apparatus of FIG. 5, heaters 17A and 18 may be provided so as to heat the fixing belt 15A and pressure roller 16. Power supplying to the heaters 17A and 18 may be turned ON and OFF, so that a temperature of the nip "N" may be maintained in an appropriate range suitable for fixing a toner image.

Also in this example, a recording member P carrying a toner image "T" to be fixed may pass through the nip "N" while the toner image "T" contacts the surface of the fixing belt 15A as shown by an arrow A.

Thus, the toner image "T" may be fixed onto the recording member P by the heat and pressure.

Also, the JIS-A surface hardness of the pressure roller 16 in the fixing apparatus 4 of FIG. 5 may be set higher than, that of the surface of the fixing belt wound around the guide member (e.g. an opposing roller 15B in the drawing). Accordingly, as similar to the fixing apparatus of FIG. 2, when only the tip margin M1 of a recording member exits from the nip N in the fixing apparatus 4 of FIG. 5, the tip margin M1 may be directed to the pressure applying member (pressure roller 16 in the drawing) side across an extension line LAA extended from the straight line LA, which is drawn from the downstream end NE to the upstream end NS of the nip N, toward the downstream side. In addition, the fixing member side separation device 19 for separating a recording member P ejected from the nip N from the surface of the fixing member composed of the fixing belt 15A may be arranged in a non-contact condition while opposing to the surface of the fixing member. Also, the gap G formed between the tip of the fixing member side separation device 19 facing the fixing member and the downstream end NE may be set smaller in size than a width W of the margin M1 of the tip of the recording member P in the sheet transfer direction.

Thus, the wrapping of the recording member P around the fixing member composed of the fixing belt 15A as well as damaging on the fixing belt 15A by the fixing member side separation device 19 can be absolutely or substantially avoided substantially in the same manner as in the fixing apparatuses of FIGS. 2 and 3. Simultaneously, a quality of a toner image after fixing may be improved and a life of the fixing belt 15A may be prolonged. Very similar to the fixing apparatuses of FIGS. 2 and 3, the recording member P ejected from the nip "N" may then be guided and is transferred by the. fixing member side separation device 19 together with the guide member 21, and is ejected onto the tray 14 (see FIG. 1).

Now, a specific configuration of the fixing apparatus 4 is now described with reference to FIG. 5. Both the opposing roller 15 and pressure roller 16 may be similarly constructed to those in the fixing apparatus of FIG. 2. The fixing belt 15A may include a base substance made of polyimide plastic having a thickness of 50 $\mu$m, for example, and silicon rubber laminated on the base substance. The silicon rubber may have a thickness of 0.2 mm and JIS-A hardness of 30 degrees (i.e. Hs: hardness spring). Also included may be a release agent layer made of PEA having a thickness of 5 $\mu$m and coated on the silicon rubber. Further, the nip "N" of FIG. 5 may be formed from a first nip portion where the pressure roller 16 does not oppose to the opposing roller 15B and only contacts the fixing belt 15A, and a second nip portion where the pressure roller 16 contact the opposing roller 15B via the fixing belt 15A. Accordingly, the nip N may range widely in a circulation direction of the fixing belt 15A, and a pressure contacting force caused between the pressure roller 16 and fixing belt 15A may relatively be small. In addition, an appropriate temperature of the nip N may be lowered.

Further, since the fixing roller 15 of the fixing apparatus of FIG. 2 is heated by the heater 17A from inside the rubber elastic layer 24 having low heat conductivity, a long idling time is required when the fixing apparatus is started up and the fixing roller 15 reaches a prescribed temperature suitable for fixing a toner image. In the fixing apparatus of FIG. 5, however, since not only the thin and small heat capacity fixing belt 15A is utilized for the fixing member, and the fixing belt 15B is not heated from inside the opposing roller 15B and is rather heated by the heater 17A disposed in the thin tension roller 15C, the idling time required when the fixing belt 15A reaches the prescribed temperature can be minimized. In the fixing apparatuses of FIGS. 2 and 5, in order to direct the tip margin M1 of the recording member P to the pressure applying member side across the extension line LAA when only the tip margin M1 exits from the nip N, surface hardness of the fixing member constituted by the fixing roller 15 and fixing belt 15A, and the pressure applying member constituted by the pressure roller 16 may be set to levels as described earlier. However, if the fixing member is formed from the fixing belt 15A, the hardness of the surface of the fixing member may be represented by a portion of the surface of the fixing belt when the fixing belt is wound by the opposing roller 15B as described-above. Importantly, when the JIS-A hardness of the surface of the pressure applying member at, the downstream end NE in the nip N is set higher than that of the surface of the pressure applying member at the upstream end NS and only the margin M1 exits from the nip N, the margin M1 may be directed to the pressure applying member side across the extension line LAA.

Another fixing apparatuses are now described with reference to FIGS. 6 and 7. These fixing apparatuses may each be substantially similar to that illustrated in FIG. 2. Thus, description of both basis configuration and function are omitted while the same codes in FIG. 2 are assigned to respective corresponding sections in the fixing apparatus of FIG. 6.

Figure 6:
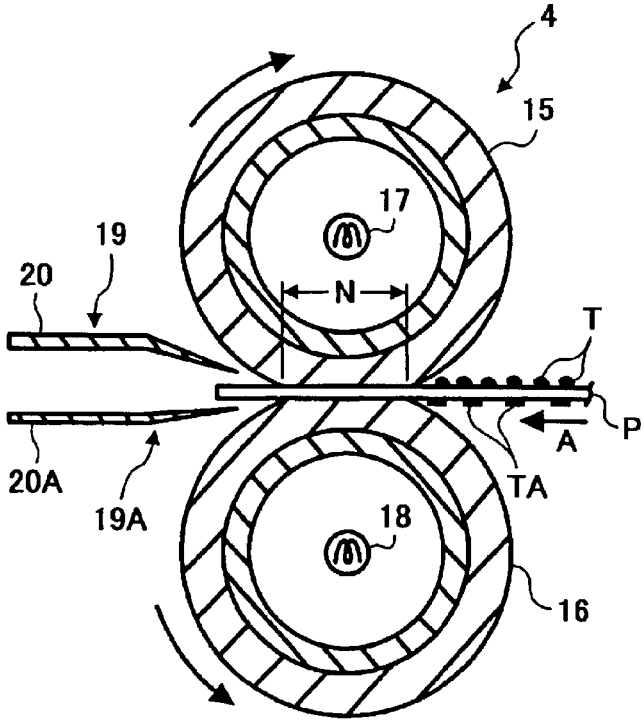
FIG. 6 is a cross sectional view for illustrating still another fixing apparatus.
Figure 7:
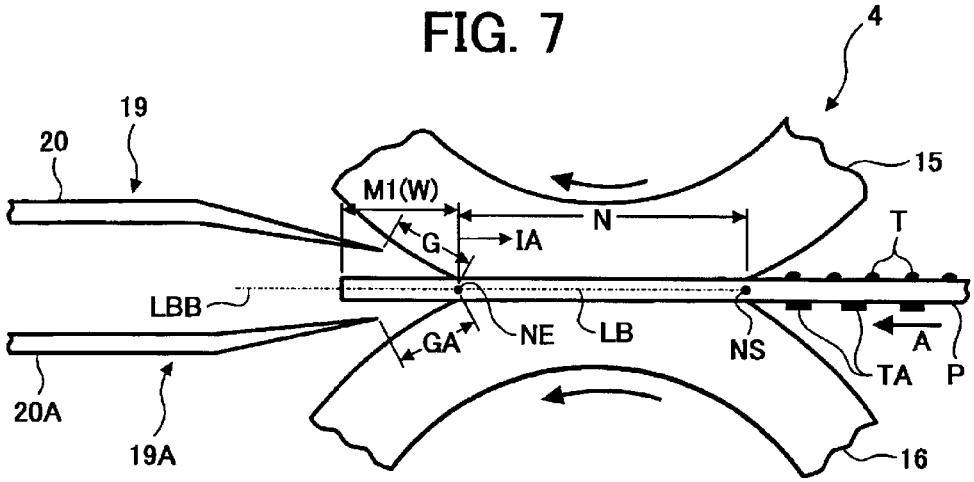
FIG. 7 is an enlarged explanatory chart for illustrating the fixing apparatus of FIG. 6.

Various differences of the fixing apparatuses of FIGS. 6 and 7 from that of FIG. 2 may be that a surface hardness of JIS-A of a fixing member composed of a fixing roller 15 is substantially the same to that of the JIS-A of a pressure applying member composed of a pressure roller 16. By setting the respective surface hardness of the fixing roller 15 and pressure roller 16 in such a manner, both the rollers 15 and 16 may be deformed to be substantially flat key pressure in the nip N formed therebetween, thereby a straight like nip N may be formed. As a result as illustrated in FIG. 7, when only the tip margin M1 exits from the nip N, it may be directed along the extension line LBB extended from the straight line LB drawn from the downstream end NE and the upstream end NS of the nip N. Further, a fixing member side separation device 19 for separating a recording member P ejected from the nip N from the surface of the fixing member composed of the fixing roller 15 may also be arranged in a non-contact condition opposing to the surface of the fixing member. Simultaneously, a gap G, formed between the downstream end NE in the nip N and the tip (chip) of the fixing member side separation device 19 facing the fixing member, may be set to be smaller in size than the width W of the margin M1.

As illustrated in FIGS. 6 and 7, since a toner image is not formed on the margin M1, the margin M1 may not tend to adhere to the surface of the fixing roller 15 due to an adherence force when only exiting from the nip N, and is ejected from the nip N along the extension line LBB. Thus, the margin M1 of the recording member P may not wrap around the surface of the fixing roller 7.5 in such a condition. When the recording member in the condition illustrated in FIGS. 6 and 7 is further transferred in a direction shown by an arrow A, an image area IA of FIG. 4 may start being ejected from the nip N, and the recording member P may adhere or tend to adhere to the surface of the fixing roller 15 due to an adhesive force of the toner on the image area IA. Thus, the recording member P may be pulled toward the fixing roller 15. However, since the fixing member side separation device 19 is disposed in the vicinity of the fixing roller 15, the recording member P may collide and is guided by the fixing member side separation device 19. As a result, wrapping of the recording member P around the surface of the fixing roller 15 maybe prevented. Simultaneously, the fixing member side separation device 19 is separately disposed from the surface of the fixing roller 15. Since the gap G is set smaller in size than the width W of the margin M1, the recording member P pulled toward the fixing roller 15 due to the toner adhesive force may be prevented from passage through the gap G and wrapping around the surface of the fixing roller while adhering to the surface of the fixing roller. The recording member P passing through the fixing apparatus 4 may then be ejected onto the tray 14 of FIG. 1.

Also in the fixing apparatus of FIGS. 6 and 7, the recording member P ejected from the nip N may be avoided from wrapping around the surface of the fixing roller 15. In addition, since the fixing member side separation device 19 does not contact the surface of the fixing roller 15, damage on the surface of the fixing roller 15, which has a low hardness and is easily damaged by the fixing member side separation device 19, may be blocked. In addition, since the nip N is a flat shape, the recording member ejected from the nip may advantageously hardly be curled when compared with a case when the nip N is curved. Both the fixing roller 15 and pressure roller 16 of the fixing apparatus of FIG. 6 can be similarly constituted to that of the fixing roller 16 of FIG. 2. The surface hardness of the fixing roller 15 and pressure roller 16 of the fixing apparatus of FIG. 6 can be 45 degrees (i.e. Hs: hardness spring) in the JIS-A. Since respective surface hardness of the fixing roller 15 and pressure roller 16 are substantially the same to each other, the nip N may be formed substantially flat.

Still another fixing apparatus 4 may be described with reference to FIG. 8. The basic configuration of a shown fixing apparatus 4 may be substantially the same to that of FIG. 5. In contrast to the tension roller 15C positioning a right side of the opposing roller 15B in FIG. 5, the tension roller 15C may position upside the opposing roller 15B in FIG. 8. However, it is not-substantial difference. Thus, the same legends are assigned to respective sections of the fixing apparatus of FIG. 8 in accordance with the sections of the fixing apparatus of FIG. 5, and description of these basic construction and function may be omitted.

Figure 8:
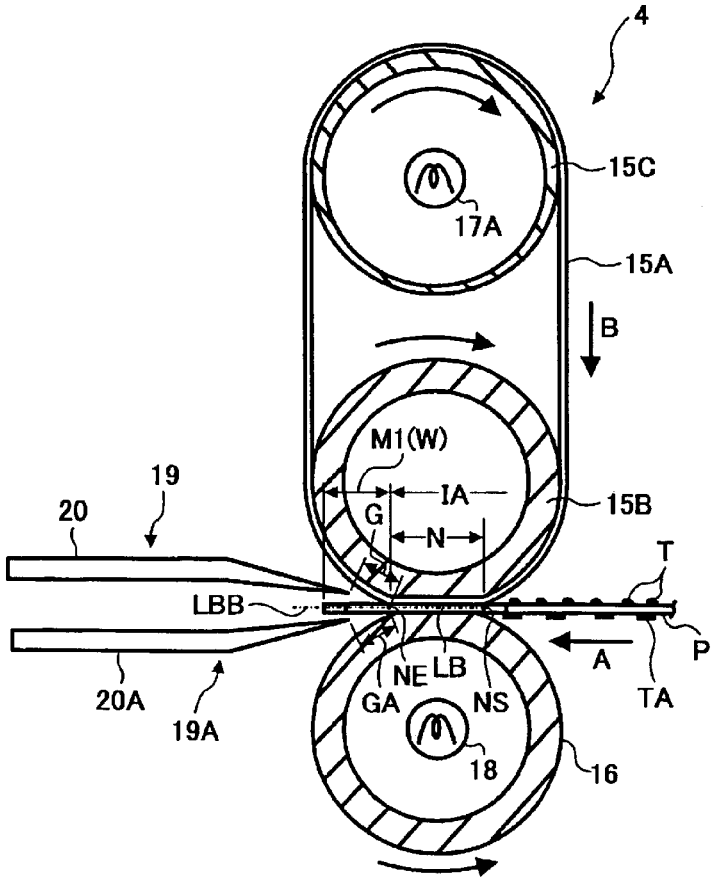
FIG. 8 is a cross sectional view for illustrating still another fixing apparatus.

A difference between these fixing apparatuses of FIGS. 8 and 5 is that a JIS-A hardness of the surface of a portion where the fixing belt 15A is wound around the opposing roller 15B is substantially the same to that of the surface of the pressure roller 16 serving as one example of the pressure applying member. Accordingly, also and similar to the fixing apparatus of FIGS. 6 and 7 in the fixing apparatus 4 of FIG. 8, when only the margin M1 in the tip of the recording member P exits from the nip "N", the margin "M1" may be directed along the extension line LBB extended from the straight line LB connecting the downstream end NE and recording member transfer direction upstream end NS in the nip. In addition, a fixing member side separation device 19 for separating a recording member "P" ejected from the nip "N" from the surface of the fixing member is arranged separated from the surface of the fixing member. The gap G formed between the downstream end NE in the nip N and the tip of the fixing member side separation device 19 facing the fixing member may be set smaller than the width W of the margin M1 formed in the tip of the recording member P in the transfer direction. Thus, similar to the fixing apparatus of FIGS. 7 and 8, wrapping of the recording member P around the surface of the fixing belt 15A may be blocked. In addition, damage on the surface of the fixing belt 15A caused by the fixing member side separation device 19 may also be blocked. Further, the recording member P ejected from the nip N can be prevented from easy curl.

When only the margin M1 of the tip of the recording member P exits from the nip N in the fixing apparatus of FIGS. 6, 7, and 8, the surface hardness of JIS-A of the fixing member composed of the fixing roller 15 or fixing belt 15A may be set to substantially the same level to that of the JIS-A of the pressure applying member composed of the pressure roller 16 in order to direct the margin M1 almost along the extension line LBB. However, if the fixing member is formed from the fixing belt 15A, the hardness of the surface of the fixing member may be that measured at a surface where the fixing belt contacts and is wound around the opposing roller 15B. In-brief, regardless of a difference in a shape of the fixing member, by setting a JIS-A hardness of the surface of the fixing member in the downstream end NE in the nip N to substantially the same level to that of the surface of the pressure applying member in the downstream end NE, the recording member P may be directed substantially along the extension line LBB when only the margin M1 of the tip exits from the nip N.

Further, the image forming apparatus 1 is configured to form a toner image only on one side surface of the recording member P. However, an image forming apparatus capable of performing the below described functions is widely known. Specifically, the image forming apparatus is capable of transferring a toner image formed on a PC member onto one side surface of the recording member, fixing the toner image with a fixing apparatus, inverting upside down and transferring the recording member again to the PC member, transferring a toner image formed on the PC member onto the other surface of the recording member, and fixing the toner image with the fixing apparatus. When toner images respectively formed on the one and other sides of the recording member require to be distinguished, the former may be termed as a first toner image, and the latter may be termed as a second toner image.

When the second toner image is transferred through the nip and is fixed, the first toner image fixed to the one side surface of the recording member may also pass and contact the pressure applying member. At that time, since the pressure applying member is also heated, the heat fuses the first toner image. As a result, the recording member ejected from the nip may likely wrap around the pressure applying member.

Then, a pressure applying member side separation device 22 for separating a recording member P ejected from the nip N from a pressure applying member (a pressure roller 16 in this example) may be employed in a fixing apparatus 4 of FIGS. 2 and 5. In addition, a tip of the separating device 22 facing the pressure applying member may contact the pressure applying member. Such a pressure applying member side separating device 22 may be formed from a plurality of separation claws arranged in an axial direction of the pressure roller 16, or a single sheet of sheet like separation member.

As illustrated in FIGS. 2 and 5, when the first toner image TA is fixed and carried on the one side surface, and the second toner image T to be fixed is carried on the other side surface when entering the nip N, since the first toner TA is heated and fused when the recording member P passes through the nip N, the recording member P ejected from the nip N sometimes wraps around the surface of the pressure roller 16. However, even in such a situation, the pressure applying member side separating device 22 contacting the surface of the pressure roller 16 may separate the recording member P from the surface of the pressure roller 16.

Since the tip of the pressure applying member side separating device 22 contacts the surface of the pressure applying member composed of the pressure roller 16, the recording member attempting to wrap around the surface of the pressure roller 16 may surely be separated therefrom. At that time, as described earlier, since the surface hardness of the pressure roller 16 is higher than that of the fixing roller 15, and accordingly, the surface of the pressure roller 16 is hardly damaged, the surface of the pressure roller 16 can be prevented from being damaged by the pressure applying member side separating device 22.

Further, as illustrated in FIGS. 6 to 8, when only the tip margin M1 of the recording member P exits from the nip N, the tip margin M1 may be directed almost along the extension line LBB. Beside, the pressure applying member side separation device 19A may be arranged being separated from the surface of the pressure applying member and separate the recording member P ejected from the nip N. In addition, the gap G formed between the downstream end NE and the tip facing the pressure applying member in the pressure applying member side separation device 19A is set smaller in size that the width W of the margin M1 formed in the downstream end of the recording member P. Such a pressure applying member side separation device 19A may be shaped in appropriate. However, it can be formed from a separation member 20A made of a sheet.

When the recording member P entering the nip N carries the first toner image TA already fixed on to one side surface and the second toner image T to be fixed by the fixing apparatus 4 on the other side surface, and passes through the nip N, the first toner image TA fuses. However, similar to the fixing member side separation device 19, the pressure applying member side separation device 19A may prevent the recording member from wrapping around the surface of the pressure roller 16. Further, since the pressure applying member side separation device 19A is distanced from the surface of the pressure roller 16, a problem of damaging the surface may be blocked.

Further, as illustrated in FIGS. 6 to 8, since the above-described fixing member side and pressure applying member side separation devices 19 and 19A are simultaneously employed, wrapping of the recording member P around either the fixing member or pressure applying member can be blocked. A fixing apparatus 4 of FIG. 9 may also be configured to block wrapping of a recording member around a pressure applying member. A basic configuration and operation of the fixing apparatus of FIG. 9 may be similar to that of the fixing apparatus of FIG. 2. Differences therebetween may be that a JIS-A surface hardness of the pressure roller may be set lower than that of the fixing roller 15, and the fixing roller 15 may deform the pressure roller 16 with a pressure. Further, a heater may be disposed in the pressure roller 16, and a heater 17 may also be disposed in the fixing roller 15 so as to heat the fixing roller 15. The nip N may be maintained at an appropriate temperature suitable for fixing. A difference in a JIS-A surface hardness between of the fixing roller 15 and pressure roller 16 may also be maintained at from about 20 to about 40 degrees (i.e. Hs: hardness spring). The fixed first toner image TA may be carried on the one side surface of the recording member P, and the second toner image T to be fixed by the fixing apparatus 4 may be carried one the other side surface, and such a recording member P may be transferred into the nip N between the fixing and pressure rollers 15 and 16 in a direction as shown by an arrow A. Thus, the second toner image T may be fixed while passing through the nip N.

At that time, the toner of the first toner image TA is heated and fused. However, to prevent the recording member P from wrapping around the surface of the pressure roller 16 due to melting toner of the first toner image, the pressure applying member side separation device 19A may be arranged so as to separate the recording member exiting from the nip N from the surface of the pressure applying member formed from the pressure roller 16 separated from the surface of the pressure applying member. A condition may be illustrated in FIG. 9 when the entire margin M1 of the transfer direction tip of the recording member P has just exited from the nip N. However, the gap GA formed between the downstream end NE of the nip N and the tip of the pressure applying member side separation device 19*a*, which faces the pressure applying member, may be set smaller than the width W of the margin M1. Such a pressure applying member side separation device 19*a* may also be formed from a sheet like separation member 20A.

Figure 9:
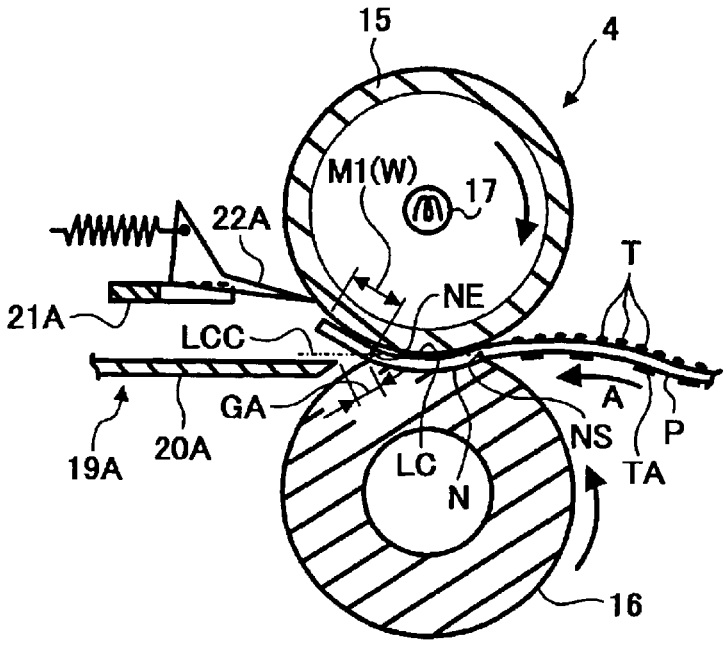
FIG. 9 is a cross sectional view for illustrating yet another fixing apparatus

As illustrated in FIG. 9, since the surface hardness of the fixing roller 15 is set higher than that of the surface of the pressure roller 16, when only the margin M1 exits from the nip N, the margin M1 may take a posture along the surface of the fixing roller 15, and is largely distanced from the surface of the pressure roller 16. Namely, when the margin M1 exits from the nip N, the margin M1 may be directed to the fixing member side across the extension line LCC extended from the straight line LC toward the recording member transfer direction side, which straight line LC is drawn from the downstream end NE to the upstream end NS.

When the image region IA of the recording member P (see FIG. 4) exits from the nip N, since the toner of the second toner image T carried on the other side surface fuses, the recording member P may sometimes be pulled toward the fixing roller 15 side. However, since the toner of the first toner image TA carried on the one side surface also fuses, the recording member P may also sometimes be pulled toward the pressure roller 16 side. Since the gap GA is smaller than the width W of the margin M1, in addition, the surface hardness of the pressure roller 16 is lower than that of the fixing roller 15, and the margin M1 does not adhere to the surface of the pressure roller 16 due to toner adhesive force when only exiting from the nip N, the regarding member P almost never wraps around the surface of the pressure roller 16 even when pulled toward the pressure roller 16 side. In addition, since the fixing member side separation devise 19A is distanced from the surface of the pressure roller 16 having a low surface hardness and easily damaged, the damage can substantially be blocked.

In addition, the fixing member side separation device 22A made of such as a sheet like separation member contact the surface of the fixing roller 15. Thus, even though the recording member P ejected from the nip N adheres to the surface of the fixing roller 15, the recording member P may immediately be separated from the surface of the fixing roller 15 by the fixing member side separation device 22A, and does not wrap around the surface of the fixing roller 15. Even if the fixing member side separation device 22A contact the surface of the fixing roller 15, the damage on the surface may be prevented, because the surface of the fixing roller 15 is harder. Thus, by contacting the fixing member side separation device 22A to the surface of the fixing roller 15, wrapping of the recording member P around the fixing roller 15 may credibly be blocked. The recording member P exiting from the nip N may be guided and is transferred by the pressure applying member side separation device 19A and guide member 21A arrange above the pressure applying member side separation device 19A. As described above, wrapping of the recording member P around both the fixing and pressure rollers 15 and 16, and damage on both of the surfaces of the fixing and pressure rollers 15 and 16 can be blocked. As a result, quality of the first and second toner images of the recording member P passing through the nip N may avoid from being decreased.

Figure 10:
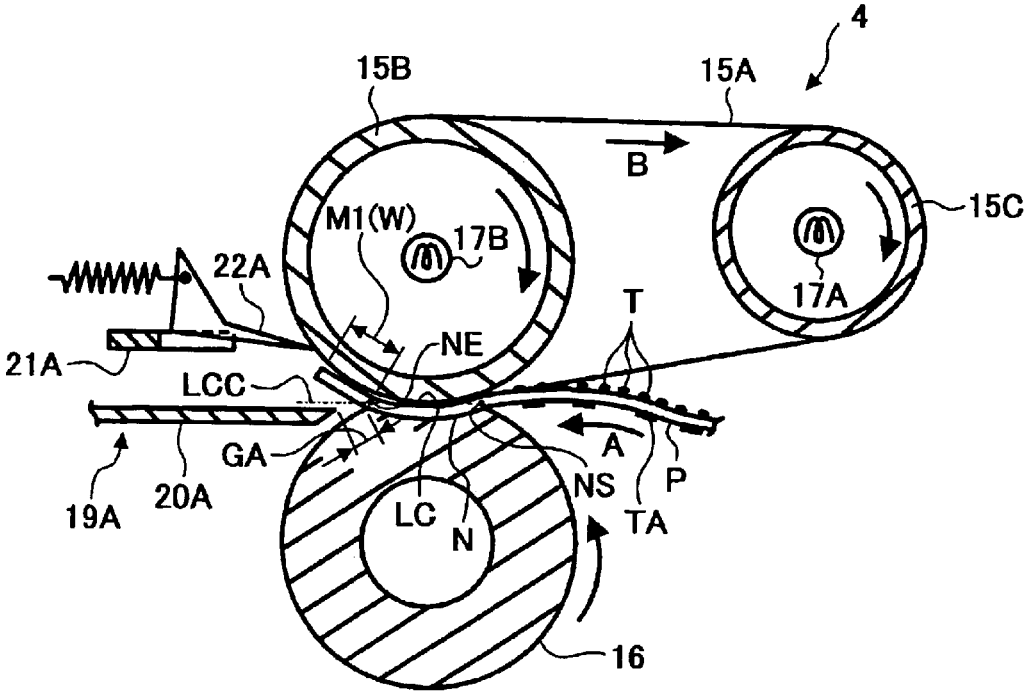
FIG. 10 is a cross sectional view for illustrating yet another fixing apparatus

One example of a specific configuration of the fixing apparatus 4 may now be described with reference to FIG. 9. An iron hollow roller having a releasing layer on its outer surface, whose outer diameter is 40 mm and thickness is 0.6 mm, may be employed for a fixing roller 15. An aluminum core metal, whose outer diameter is 40 mm, carrying a foam silicone rubber layer whose thickness is 5 mm, on the core metal and including a PEA tube having thickness of 30 $\mu$m around the foam silicone rubber layer may be employable for a pressure roller 16. In this configuration, since no elastic layer is formed on the fixing roller 15, heat capacity of the fixing roller 15 may be small, and accordingly, a startup time required when the fixing roller 15 reaches a prescribed temperature available for fixing from when a power supply is turned ON may be minimized. In addition, a relation that a surface hardness of a fixing member is higher that that of a pressure applying member may be applicable to a configuration where a fixing member is formed from a fixing belt as illustrated in FIG. 10. A basic thought of the fixing apparatus 4 of FIG. 10 may be similar to the fixing apparatus of FIG. 9.

Briefly, a fixing member heated by the heaters 17A and 17B may be formed from a fixing belt 15A wound and rotated around a guide member formed from an opposing roller 15B and a tension roller 15C in this example, in a direction shown by an arrow B. A pressure applying member pressure contacting the fixing member may be formed from a pressure roller 16 contacting at least one guide members, i.e., the opposing roller 15B in this example, via the fixing belt 15A, and rotating in a direction shown by an arrow. The JIS-A surface hardness of the pressure roller 16 may be set lower than that on a portion of the fixing belt contacting the opposing roller 15B.

The recording member P carrying a second toner image T to be fixed may pass through a nip N formed by pressure contact of the fixing belt 15A and pressure roller 16 with the second toner image T being directed to contact the fixing belt 15A. When only a margin M1 formed in the transfer direction tip of the transferred recording member P exits from the nip N, the tip margin M1 may be directed to the fixing member (i.e., the fixing belt 15A) side across an extension line LCC extended from the straight line LC drawn from the downstream end NE to the upstream end NS of the nip N in the transfer direction.

As shown by an arrow A, the first toner image TA having already been fixed may be formed on the one side surface of the recording member P entering into the nip N. In addition, the pressure applying member (i.e., the pressure roller 16) side separation device 19A may be arranged separately from the surface of the pressure applying member so as to separate the recording member P ejected from the nip N. Further, a gap GA formed between a downstream end NE of the nip N and a tip of the pressure applying member side separation device 19A, which faces the pressure applying member, may be set smaller in size than the width "W" of the margin M1 formed in the tip of the recording member P in the transfer direction A. Owing to this configuration and similar to the fixing apparatus of FIG. 9, the recording member P may avoid from wrapping around the pressure roller 16. In addition, the pressure applying member side separation device 19A may also be blocked damaging the pressure roller having slow surface hardness. In addition, the fixing member side separation device 22A contacting the fixing belt 15A may block the recording member P to wrap around the fixing belt 15A. The recording member P ejected from the nip N may then be guided and transferred by the pressure applying member side separation device 19A together with the member 21A.

Also in the cases of the fixing apparatuses of FIGS. 9 and 10, the JIS-A surface hardness of the fixing member at the downstream end NE may be set higher than that of the pressure roller side at the same position NE, so that the tip blank "M1" is directed to the fixing member side across the extension line LCC when only exiting from the nip "N". In addition, since the fixing member side separation device 22A contacts the fixing member so as to separate the recording member P ejected from the nip N from the fixing member, wrapping of the recording member around the fixing member may efficiently be blocked. In addition, since the surface of the fixing member is hard, damage on the fixing member, which is caused by the fixing member side separation device 22A, can be blocked. Further, in the above-described respective embodiments, the gap G formed between the downstream end NE of the nip N and the tip of the fixing member side separation device 19 is set to be smaller in size than the width W of the margin M1, the tip of the fixing member side separation device 19 may position in the vicinity of the fixing member. In order to precisely arrange the fixing member side separation device 19 in such a position, the below-described configuration may preferably be adopted.

Figure 11:
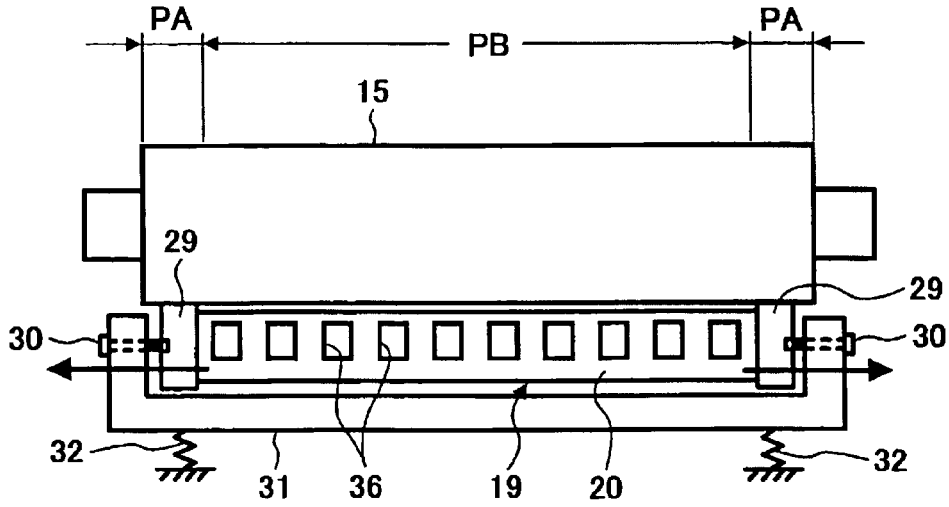
FIG. 11 is a plan view for illustrating one example of a separation member supporting apparatus.
Figure 12:
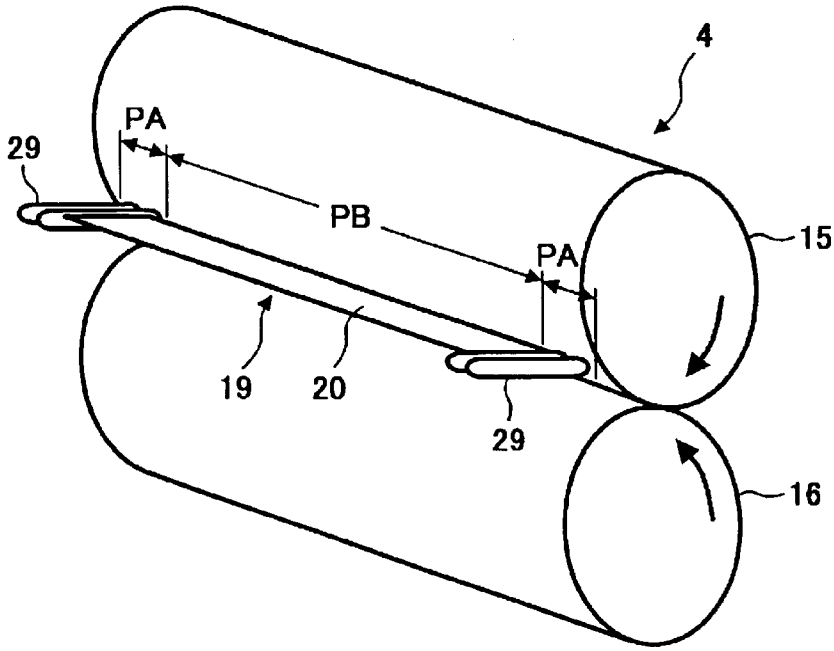
FIG. 12 is a perspective view for illustrating a condition in that a gap-maintaining member of FIG. 11 contacts the surface of the fixing roller.

FIG. 11 illustrates an exemplary configuration for positioning a fixing member side separation device 19 composed of a sheet like separation member 20 with regard to a fixing roller 15 of FIGS. 2 and 6. As illustrated in FIG. 11, a pair of gap holding members 29 may be secured to respective ends of the separation member 20 in the longitudinal direction, i.e., respective ends of the fixing member side separation devices in the direction perpendicular to a transfer direction of the recording member. In addition, the respective gap holding members 29 may be supported by the supporting member 31 via a pair of screws 30. The supporting member 31 may be biased against a surface of a fixing roller 15 by a pair of pressure applying members 32 such as compression springs. Thus, both the gap holding members 29 may contact the surface of the fixing roller 15. As illustrated in FIG. 12, both the gap holding members 29 may contact recording member non-passing areas PA on the fixing roller 15, i.e., longitudinal direction end regions on the fixing roller, where the recording member does not pass through. As a result, the above-described gap G between a tip of the fixing member side separation device 19, which opposes a recording member passing region, and the surface of the fixing roller 15 may precisely be maintained.

The position of the surface of the fixing roller 15 is not constant because of receiving influence of heat expansion and eccentricity of the roller. However, when the fixing member side separation device 19 is positioned in the above-described manner, the gap G can be maintained substantially constant along the entire longitudinal direction of the fixing member side separation device 19. In addition to that, the gap holding members 29 contact the recording sheet non-passing areas PA, the gap holding members 29 may almost never damage the recording member passing area PB. In addition, influence from the gap holding member 29 contacting the fixing roller 15 may be avoided.

Similar to those described above, when the fixing members of FIGS. 5 and 8 are each formed from the fixing belt 15A, both the interval between the fixing member side separation device 19 and surface of the fixing belt 15A, and the gap G can be correctly regulated by enabling the gap holding member 29 to contact the recording member non-passing area.

By employing the gap holding member in respective ends of the fixing member side separation device in the direction perpendicular to the recording member transfer direction, while enabling the respective gap holding members to contact the recording member non-passing areas, and holding the interval between the tip of the fixing member side separation device and surface of the fixing belt 15A in the above-described manner, the tip of the fixing member side separation device can readily be approximated and correctly positioned regarding the fixing member. Also, in order to position the pressure applying member side separation device 19A when approximating the surface of the pressure roller 16, the configuration illustrated in FIGS. 11 and 12 may be similarly employable. Specifically, instead of using for the fixing roller 15 of FIGS. 11 and 12, it may be arranged for the pressure roller 16 illustrated in FIGS. 9 and 10. In this way, the gap holding members are arranged in respective ends of the pressure applying member side separation device in the direction perpendicular to the recording member transfer direction, and the respective gap holding members can contact the recording member non-passing area of the fixing member. As a result, the gap between the tip of the pressure applying member side separation device and surface of the pressure applying member may be precisely maintained, and the pressure applying member side separation device can be approximated and is correctly positioned in relation to the surface of the pressure applying member. In addition, since the gap holding member contacts the recording member non-passing area, the recording member non-passage area can avoid from a problem of damaging. Instead if using the sheet like separation members 20 and 20A, a separation device formed from a separation claw composed of a single plate member or a plurality of separation claws arranged along the surfaces of the fixing and/or pressure applying members can be employed for the fixing member side separation device 19 and the pressure applying member side separation device 19A, each of which are distanced from the fixing and pressure applying members. However, since the fixing member side and the pressure applying member side separation devices 19 and 19A are arranged separately from the fixing and pressure applying members, respectively, one sheet like or plate like separation member as illustrated in the drawing can be employed for each of the respective separation devices 19 and 19A. When the separation device contacts the surface of the fixing or pressure applying member, a separation device formed from a plurality of separation claws is necessarily employed, and a spring should adjusts pressure of the respective separation claws contacting the respective fixing and pressure applying members so as to even out the contact pressure. However, since both the fixing member side and the pressure applying member side separation devices 19 and 19A do not contact the fixing and pressure applying members, respectively, the contact pressure does not need adjustment, and these fixing member side separation device 19 and pressure applying member side separation device 19A can be formed form a single separation and are adopted. By constructing respective separation devices 19 and 19A in this manner, a number of parts and cost therefor can be decreased. In addition, since a spring for adjusting contact pressure of the fixing member side separation device 19 and pressure applying member side separation device 19A against the fixing and pressure applying members, respectively, can be omitted, both the fixing member side separation device 19 and pressure applying member side separation device 19A can be integrated with a guide member for recording member use and a casing of the fixing apparatus (not shown). Further, as illustrated in FIG. 11, if one or more openings 36 are formed in a separation member 20 forming the fixing member side separation device 19 so as to ventilate, water vapor generated from a recording member heated in the nip N may be evacuated upward via the openings 36. Thus, a problem that the water vapor is condensed on the recording member P, and thereby decreasing in a quality may be blocked. Similarly, one or more openings for ventilation may be formed in a separation section 20A forming a pressure applying member side separation device 19A, water vapor generated from a recording member may similarly be evacuated upwardly via the openings.

As illustrated in the drawing, both the fixing member side separation device 19 and the pressure applying member side separation device 19A are made from sheet like separation members 20 and 20A, and in particular, if those thickness are thin, waving due to heat expansion of these separation members, and deformation due to contacting of the recording member to the separation members 20 and 20A may arise. As a result, a gap between each of the separation members 20 and 20A and fixing member or pressure applying member may likely be uneven in a longitudinal direction of the separation member. Then, if both the fixing member side separation device 19 and the pressure applying member side separation device 19A are made from sheet like separation members 20 and 20A, a tension applying device for pulling the separation members 20 and 20A in a direction perpendicular to a recording member transfer direction may preferably be employed. Then, the above-described problem may be blocked.

The separation member 20 may be secured to the gap holding member 29 via respective ends in the longitudinal direction, and the both of the gap holding members 29 are supported by the supporting members 31 via screws 30. However, the separation member 210 may be maintained flat by screwing the screws 30, and pulling the separation member 20 in a direction shown by an arrow, and applying a tension thereto. Thereby, a gap between the separation member 20 and fixing roller 15 can be maintained constant. In such a manner, the screws 30 may constitute an exemplary tension-applying device for pulling the separation member. A tension-applying device for pulling the separation member 20A of the pressure applying member side separation device 19A may similarly be configured.

For the sheet like separation members 20 and 20A, a thin plate of heat resistance plastic or metal may be employed. For example, fluorine plastic, and polyimide having a thickness of 0.1 mm may be employed. In addition, if a metal sheet or metal plate member having a thickness of 0.2 mm is employed for the sheet like separation members 20 and 20A, since rigidity is enhanced, a gap between the separation member and fixing member or pressure applying member can be maintained constant without employing the above-described tension applying device.

Further, in order to credibly avoid wrapping of the recording member around either the fixing or pressure applying member in the above-described respective fixing apparatuses, release agent such as silicone oil can be coated on each of these apparatuses. However, when employing such a configuration, the oil adheres and soils the recording member, and maintenance may be complex due to oil coating. In addition, a coating member for coating oil may be necessitated, thereby resulting in cost increase for the fixing apparatus.

Then, if wax including toner is used so as to form a toner image with plastic and coloring agent, so called oil less image formation may be realized without coating release agent. As a result, the above-described problem can be removed.

Figure 13:
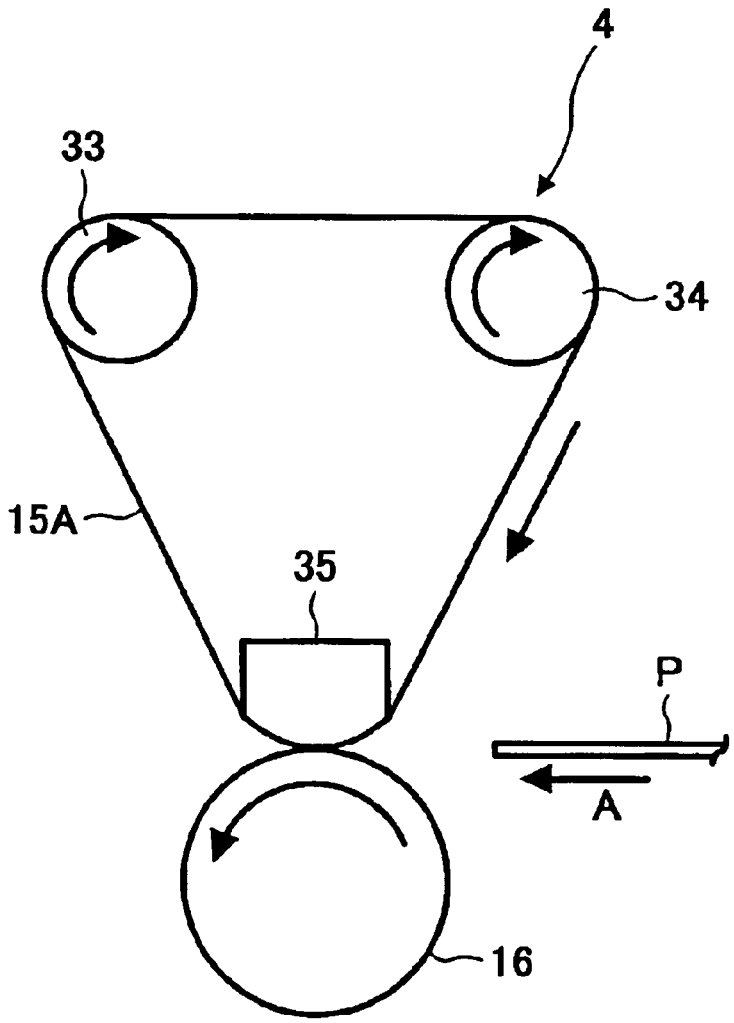
FIG. 13 is an explanatory diagram for illustrating a still another fixing apparatus.

The above-described respective configurations may be widely applied to fixing apparatuses other than those described above. Even though the guide roller formed from a roller 15B and tension roller 15C are employed for a guide member for winding the fixing belt 15*a* in the fixing apparatus of FIGS. 5, 8, and 10. However as illustrated in FIG. 13, a guide member configured by a pair of the guide rollers 33 and 34, and heater 35 can be employed in the fixing apparatus 4 so as to wind a fixing belt 15A therearound. The heater 35 may include a pair of electrodes, and a resisting member arranged between the electrodes and contacting the internal surface of the fixing belt 15A. Thus, the resisting member may be enabled to generate heat when receiving power supply thereby heating the fixing belt 15A. Also in such a fixing apparatus, various configurations described earlier with reference to FIGS. 5, 8 and 10 may be adopted.

In addition, a pressure belt wound and driven by a plurality of guide members as described earlier can configure the pressure applying member. In such a case, when the pressure belt portion wound around the guide member contacts and forms a nip with the fixing member, the JIS-A surface hardness of the pressure belt may be obtained by measuring a surface of the pressure belt portion contacting and wound around the guide member.

Figure 14:
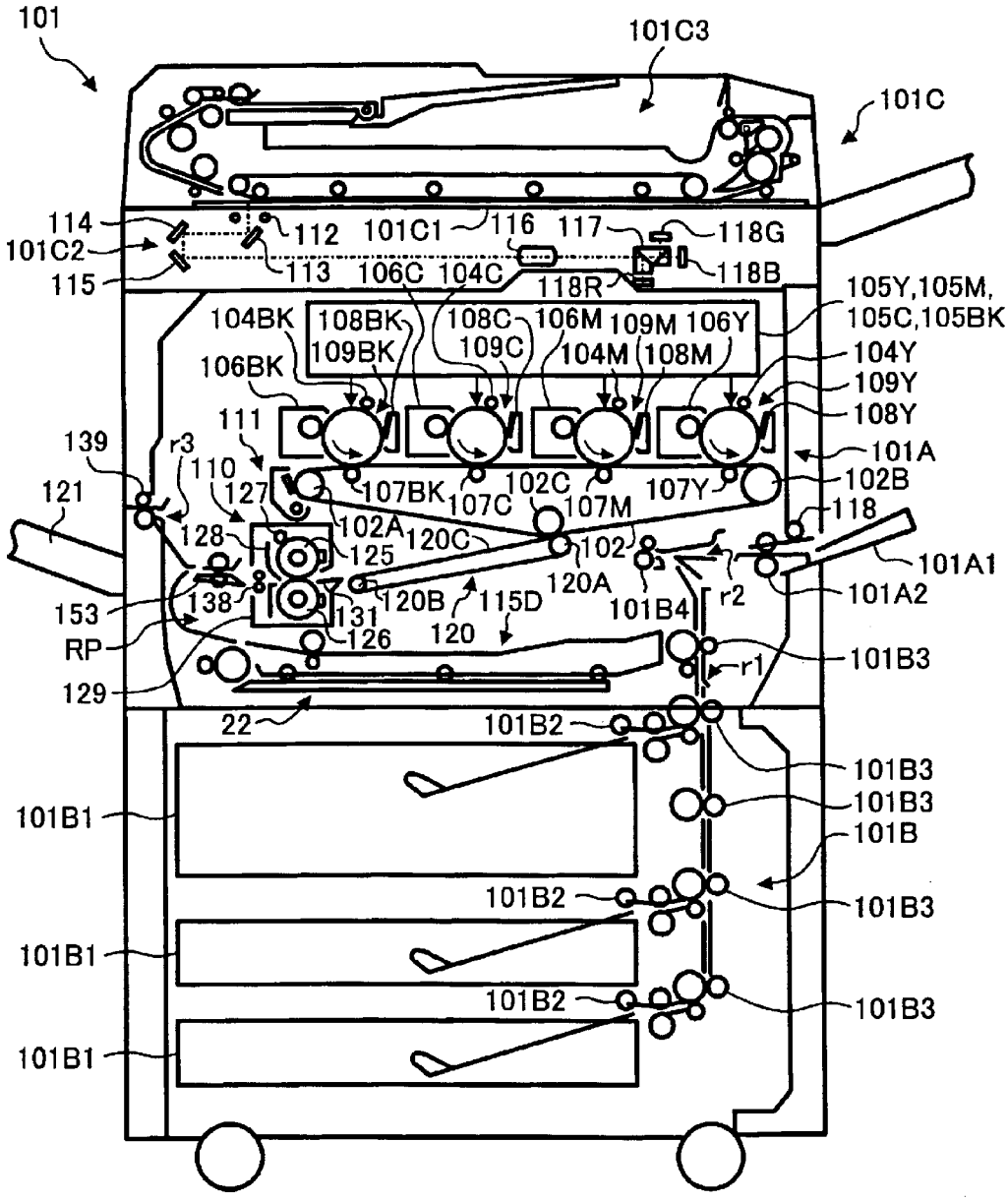
FIG. 14 is a schematic chart for illustrating a color image forming apparatus installing one exemplary configuration of a fixing apparatus according to the present invention.
Figure 15:
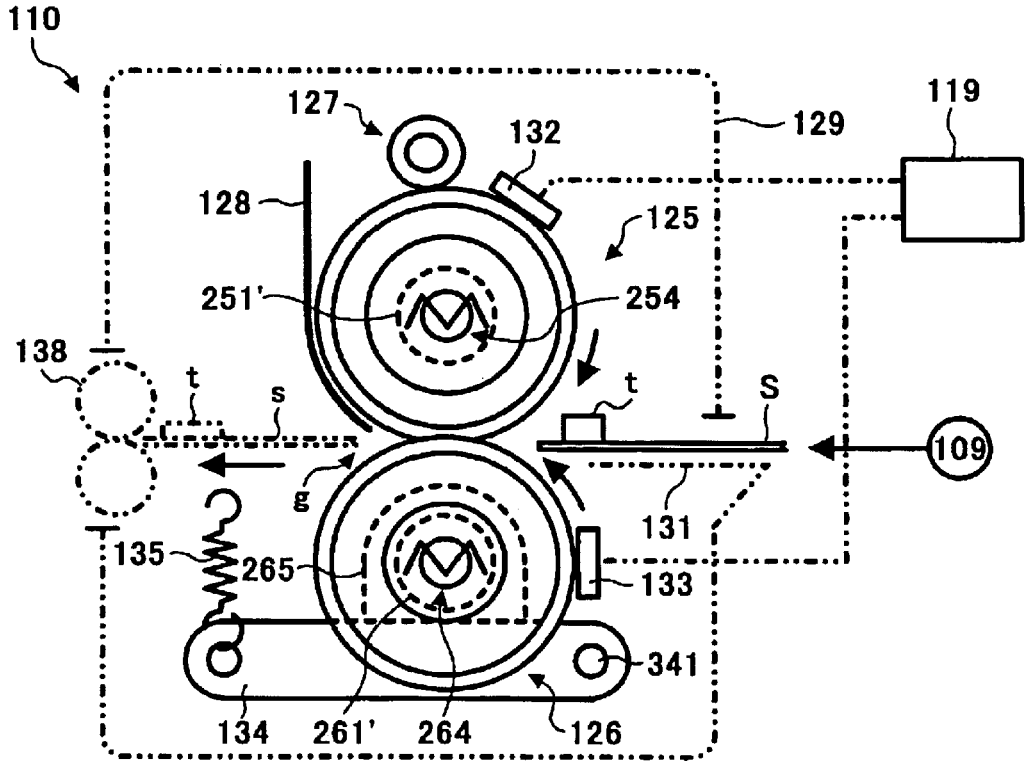
FIG. 15 is a schematic enlarged chart for illustrating a configuration of the fixing apparatus utilized in the image forming apparatus of FIG. 14.

Another embodiment is now described with reference to FIGS. 14 to 24. As illustrated in FIGS. 14 and 15, a fixing apparatus 110 is a roller type that includes an oil strainer formed from a plastic parent material in which wax is included and dispersed as release agent. The fixing apparatus 110 may include a fixing roller 125 serving as a rotational fixing device, and a pressure roller 126 pressure contacting the fixing roller 125 as a pressure device. Also provided may be a cleaning roller 127 for removing paper dust or the like remaining on the surface of the fixing roller 125, and a separation sheet 128 arranged in an exit side of the nip of a fixing roller 125. Each of the rollers 125, 126 and 127 may be pivotably secured to a fixing apparatus use base frame secure to a portion of a wall surface of an image forming section 101A. The separation sheet 128 may be secured to a fixing apparatus use base frame 129 via a guide member 130 (see FIGS. 17 and 18) as described later in detail. Further, a transfer guide member 131 may be attached to a portion of the fixing apparatus use base frame 129, which opposes to the end of a second transfer apparatus 109, and guide and lead a recording member carrying a not yet fixed toner image to a nip N formed between the fixing and pressure rollers 125 and 126.

Figure 16:
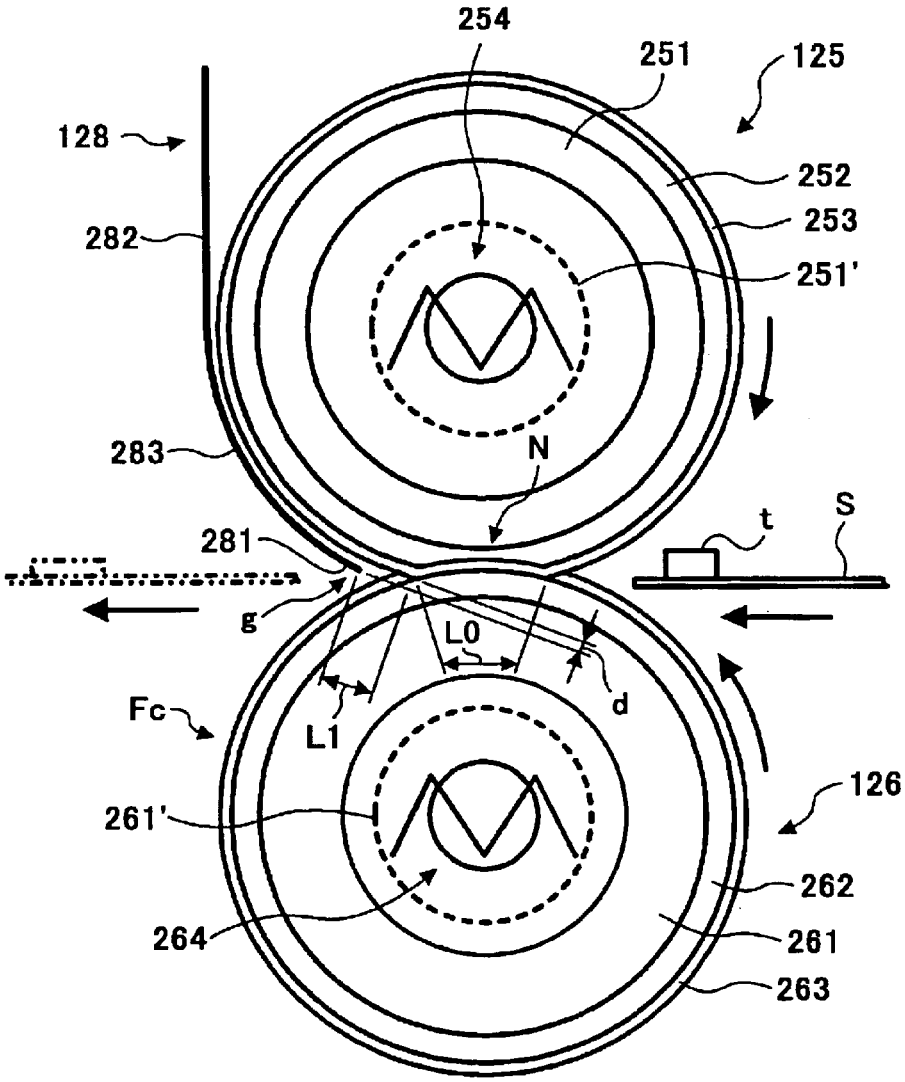
FIG. 16 is a schematic enlarged configuration chart for illustrating a fixing roller and pressure applying roller utilized in the fixing apparatus of FIG. 15.

As illustrated in FIG. 16, the fixing roller 125 may include a core metal 251 as a roller section, and an elastic layer 252 wrapping around the core metal 251, and a release agent layer 253 each integrally connected around the roller section.

The fixing roller 25 may have a diameter of 60 mm, for example. Also included may be a ring like elastic layer 252 molded and processed for obtaining a nip width "LO" around the outer surface of a Fe core metal 251. Such a ring like elastic layer 252 may be made of heat resistance elastic member such as liquid type foam silicone rubber. The ring like elastic layer 252 may include a release agent ring state layer 253 so as to wrap and integrally is coated on the outer surface of the ring like elastic layer 252. Such a release agent ring state layer 253 may be formed from heat resistance plastic having prescribed intensity in conjunction with releasability. A halogen type heater 254 may be arranged inside the metal core of the fixing roller 25 so as to accelerate increasing in temperature of the fixing roller.

As illustrated in FIG. 15, a thermistor 132 may be arranged slidably contacting the surface of the fixing roller 25. A temperature control section 119 serving as a portion of an image processing section may be configured to adjust a surface temperature of the fixing roller 25 within a prescribed range based upon detected temperature. Material having heat resistance and small surface energy may be employed as a release layer 253 of FIG. 16. For example, heat resistance silicone plastic, and fluorine plastic such as ploly-tetra-fluoro ethylene (PTFE), PFA, FEP, etc., may be employed as a heat resistance tube.

A surface hardness of the fixing roller 25 may be around 30 to 50 degrees (i.e. Hs: hardness spring)(Asker-C: measurement in conformity to Japanese Rubber Association Standard). The pressure roller 26 may include a heat resistance elastic layer 262 such as silicone rubber, and a surface release layer 263 forming an endless pressure surface Fc made of fluorine plastic on the outer surface of an Al or Fe core metal 261. In this example, the surface hardness of the pressure roller 26 may be higher than that of the surface of the fixing roller 25, and accordingly, a fixing use nip having a width LO is formed with its both ends being concave downward in a contact portion of the fixing belt and pressure roller to improve separation performance of the recording sheet having the toner. In the embodiment, a thickness of the elastic layer 262 may amount to about 0.5 mm to 2 mm, and the surface hardness may be 70 to 90 degrees (i.e. Hs: hardness spring)(Asker-C type). A halogen heater 624 may be arranged in the pressure roller 126 so as to accelerate increasing in temperature thereof. As illustrated in FIG. 15, a thermistor 133 maybe attached slidably contacting the surface of the pressure roller 126. Thus, a temperature control section 19 constituting an image processing section may be configured to adjust a surface temperature of the pressure roller 125 within a prescribed range based upon detected temperature information.

A journal 261' integral with an end of the core metal of the pressure roller 126 may be movably attached to the fixing apparatus use base frame 129 so as to move up and down in order for the pressure applying roller 126 to separate from the fixing roller 125. Specifically, the journal 261' may be supported by a lever 134 via a pivot section 265 pivotally supporting the journal 261'. A key axis of the lever 134 may pivotally be connected to the fixing apparatus use base frame 129 and a swinging end thereof is pivotally engaged with a tension spring 35 whose one end is engaged with the fixing apparatus use base frame 29.

Figure 17:
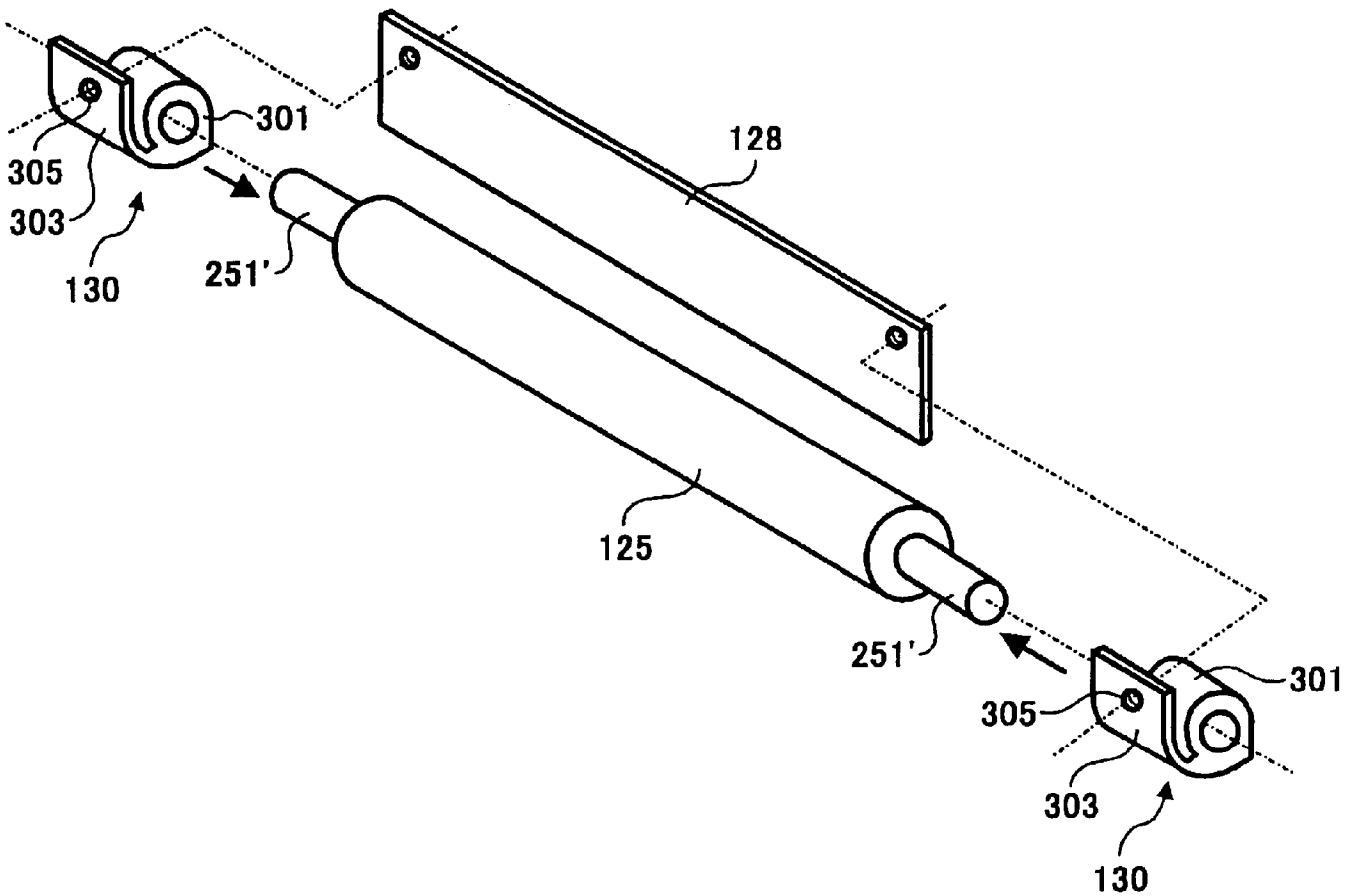
FIG. 17 is an exploded perspective view for illustrating a fixing roller, and a separation sheet, and a guide member utilized in the fixing apparatus of FIG. 15.

Thus, the lever 134 may elastically receive upward tension force. Thus, the tension spring 135 may enable the pressure roller 26 to pressure contact the fixing roller 25. The fixing apparatus 110 may include a rotational driving unit (not shown) that transmits rotational driving force to the pressure roller 126. Such rotational driving force can be transmitted to the fixing roller 125. As illustrated in FIGS. 15 and 16, a separation sheet 128 may be arranged in an exit side "g" of the nip of the fixing roller 125 so as to avoid the recording member from wrapping around the fixing roller 125. As illustrated in FIGS. 17 and 18, a diameter of a paper transfer station of the fixing roller 125 may be 60 mm, for example, and include a pair of journals 251' (i.e., an integral portion with the both end portions of the metal core 251) having 30 mm at both ends, respectively. The journal 251' may be supported by a bearing section 301 of the guide members 130 via bearings (not shown).

The pair of guide member 130 may symmetrically be shaped. Each of the pair of guide members 130 may be formed from a bearing section 301 pivotally supporting the journal 251', and an attaching wall 302 disposed at its one side and secured to the fixing apparatus use base frame 129 via the bracket 136, and a sheet reception section 303 extending from the other end of the bearing section 301. Since the pair of left and right guide members 30 is secured to the fixing apparatus use base frame 129 via the bracket 136, it may not rotate even if the fixing roller 125 rotates. The sheet reception section 303 may be a thick plate like and form a concave sheet groove 301 while maintaining a gap "j" with the other surface f1 of the bearing section 304 at an upper opening.

Figure 18A:
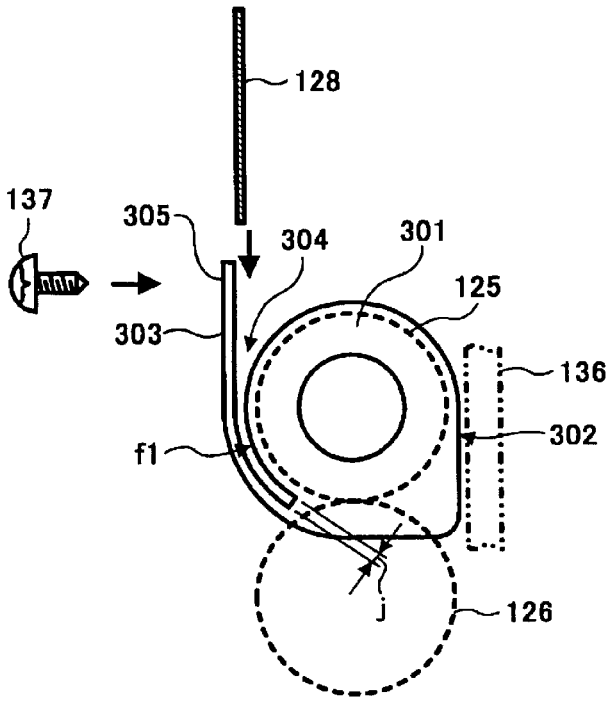
FIGS. 18A and 18B are enlarged cross sectional views each for illustrating a guide member utilized in the fixing apparatus of FIG. 15, and conditions before and after the separation sheet is attached.
Figure 18B:
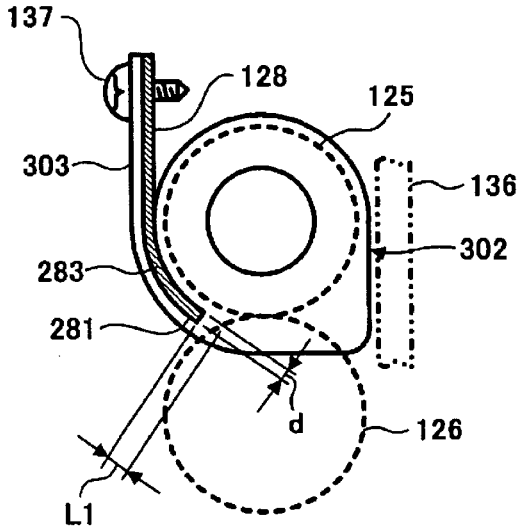

As illustrated in FIGS. 18A and 18B, the separation sheet 28 may precisely be attached to prescribed positions in relation to the fixing roller 125 by inserting a separation sheet 128 along the respective grooves 304 of the pair of left and right guide members 130. Further, the gap "j" of the respective sheet grooves 304 may have substantially the same width to a thickness of the separation sheet 128. A screw hole 305 may be formed at an upper end of the sheet reception section 303 so as to receive a sheet fastening use screw for securing the separation sheet 128 inserted and supported by the sheet groove 304. The separation sheet 128 may be a sheet like having a thickness about 0.1 to 0.2 mm made of such as a heat resistance plastic sheet, a metal thin sheet, etc.

The separation sheet may include a straight portion 282 and a concave portion 283 having a curvature almost along the outer diameter shape of the release layer. The separation sheet may maintain a prescribed gap "d" at its tip with a releasing layer in the vicinity thereof. Also include may be a tip 281 of a tip of the concave section 283. The tip 281 may be distanced from the nip exit end of the fixing roller by a prescribed length L1. Further, typically, a distance from a tip of a recording paper S to that of an image may be called as a tip blank width as described earlier. However, when the paper exits from the nip exit "g", the recording sheet "S" may indeed not wrap around the fixing roller 25 unless the tip blank width exits from the nip.

However, a mechanism likely withdrawing and wrapping the recording sheet "S" around the fixing roller 125 due to adhesive force caused by the fixing roller 125 just when the image tip exits from the exit "g" may be employed. To avoid wrapping of the recording sheet "S", if the distance "L1" from the tip of the separation sheet 128 and that of the nip exit "g" (i.e., a distance from the end of the nip exit "g") is smaller than the tip blank width, the recording sheet S may not wrap around the fixing roller 125 and relatively readily be separated by the separation sheet 128. Then, the recording sheet may be transferred and ejected onto an ejection tray by the ejection rollers 138 and 139. Since the tip blank width in the fixing apparatus 110 of FIG. 14 maybe set to 3 mm, for example, the tip portion 281 of the separation sheet 128 may be attached so that the distance L1 from the nip exit end can amount less than 3 mm.

Figure 19:
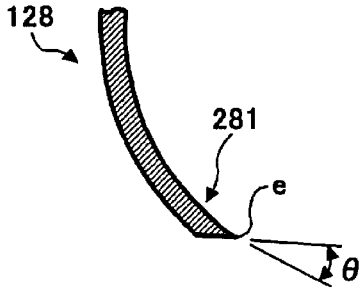
FIG. 19 is an enlarge cross sectional view-for illustrating a tip of the separation sheet utilized in the fixing apparatus of FIG. 15.

The separation sheet 128 may generally have substantially the same thickness at its tip 281 to the other. However, as illustrated in FIG. 19, a ridge of the tip portion 281 facing the separation layer 253 may be formed in a sharp edge "e" having an angle θ. Thus, the recording sheet tip easily is trapped even if the tip portion 281 has substantially the same thickness to the other. However, if the tip portion 281 of the separation sheet 28 forms the ridge "e", the ridge edge "e" may more credibly separate the recording sheet tip from the fixing roller 125 even if a thin recording sheet is ejected while wrapping around the fixing roller 25 from the nip exit "g".

Further, a surface roughness of the edge section "e" may be less than 0.2 μm (Ra) (arithmetic mean roughness). Thus, the recording member separation performance may credibly be maintained, and durability of the fixing roller 25 may be improved. In addition, thin film coating can be performed with such as fluorine plastic on the surface of the separation sheet 128, so that damaging on the fixing roller 125 can be lowered even if the separation sheet 128 contacts the fixing roller 125, in particular, in the release layer 253. In addition, the separation sheet 128 and releasing layer 253 of the fixing roller 125 of FIGS. 15 and 16 may be distanced from each other by a gap "d". The gap "din" may ideally preferably be 50 μm not to enter into the gap between the fixing roller 125 and separation roller 128 even if the thinnest sheet wraps therearound.

However, adjusting the gap to less than 50 μm may practically be difficult due to a straightness of the tip portion of the separation sheet 128, and vibration of the fixing roller when rotated. If the gap "d" is narrowed, the fixing roller 125 may dispose heat and lower its surface temperature as another problem when the fixing roller 125 contacts or is in the vicinity of the separation sheet 128. According to the present embodiment, a pair of left and right guide members 130 of FIG. 17 may be employed, and the gap "d" may preferably be set to about 0.5 mm considering parts prevision. Now, a process where a superimposed multi-color or mono-color toner image not yet fixed is fixed by fixing and pressure rollers onto a recording sheet S may be described with reference to FIGS. 20 to 24.

The toner image "t" on a recording sheet S having reached the fixing apparatus 110 may be heated by the fixing roller 125 up to a level where its viscosity is lowered, and then penetrates into a texture of the recording sheet by an operation of the pressure force of the pressure roller 115. The toner may then be firmly fixed to the sheet texture when cooled and consolidated. However, if temperature of a toner layer is less than its softening temperature Ts when separated from the fixing roller 125, the toner plastic may not sufficiently be softened, and accordingly, not penetrate into the texture of the sheet S, thereby resulting in insufficient fixing intensity.

In contrast, if the temperature of a toner layer is less than its flowage starting temperature Tf when separated from the fixing roller 25, the toner plastic viscosity may be too low, and accordingly, releasability of the toner from the release layer 253 of the fixing roller 25 may be insufficient even though sufficiently penetrating into the texture of the recording sheet S. In addition, a problem such as offset or wrapping may arise on the fixing roller 25. Accordingly, a control temperature for fixing maybe determined so that a toner layer surface temperature after fixing will fall within a range from Ts to Tf.

Preferably, a control system may be used if its temperature deviation is small at around the its center area.

Even if fixing from thin to thick sheets by substantially the same temperature, since heat capacity of the sheet is different from the other, the higher the toner layer surface temperature after fixing is, the thinner the sheet is, vice versa. As a result, even the offset phenomenon does not arise when the thin sheet passes, an adhesive force between surfaces of the respective fixing and pressure rollers may be large. In addition, separation after passage of the recording sheet through the nip may be difficult, and in the extreme case, the tip may wrap around the curvature of the fixing roller 25 and is carried. Depending upon the largeness of the adhesive power, when the tip is slightly peeled off, the recording sheet may be withdrawn by its gravity. However, a certain portion may not be peeled off and wraps therearound. Such adhesive power have been known to vary in accordance with changes in environment, toner adhering amount, and temperature of a fixing roller 125 or the like. Among these, a wrapping phenomenon of a thin sheet likely wrapping around a fixing roller is now described.

After the recording sheet S is sandwiched into the nip between the fixing and pressure rollers 125 and 115, the toner image may be fixed onto the recording sheet S while receiving operations of heat and pressure. A nip shape formed by the fixing and pressure rollers 25 and 15 pressure contacting each other may be determined from a relation between thickness and hardness of rubber layers of the respective fixing roller 125 and pressure roller 126.

As one example of embodiments, the fixing roller 125 may have a diameter of 60 mm and a thickness of 2 mm for a Si rubber, and 20 degrees (i.e. Hs: hardness spring) by the JIS-A hardness standard for a rubber layer. The pressure roller 126 may also have a diameter of 60 mm and a thickness of 2 mm for an Si rubber, and 30 degrees (i.e. Hs: hardness spring) by the JIS-A hardness standard for a rubber layer. In addition, the PFA tubes each having a thickness of 50 μm may be employed on the respective uppermost layers. In such a combination of rollers, if tack strength caused between the surfaces of the respective toner layer and fixing roller is negligible, the recording sheet S at the exit may slightly be directed downwardly from the horizontal line. When considering stable transfer performance, a discharge angle of the recording sheet S may preferably be directed slightly downwardly. However, if it is directed excessively downwardly, the first surface side of a duplex fixing image likely wraps around the pressure roller 126. Thus, sufficient attention should be paid when both the fixing and pressure rollers are designed.

Figure 20:
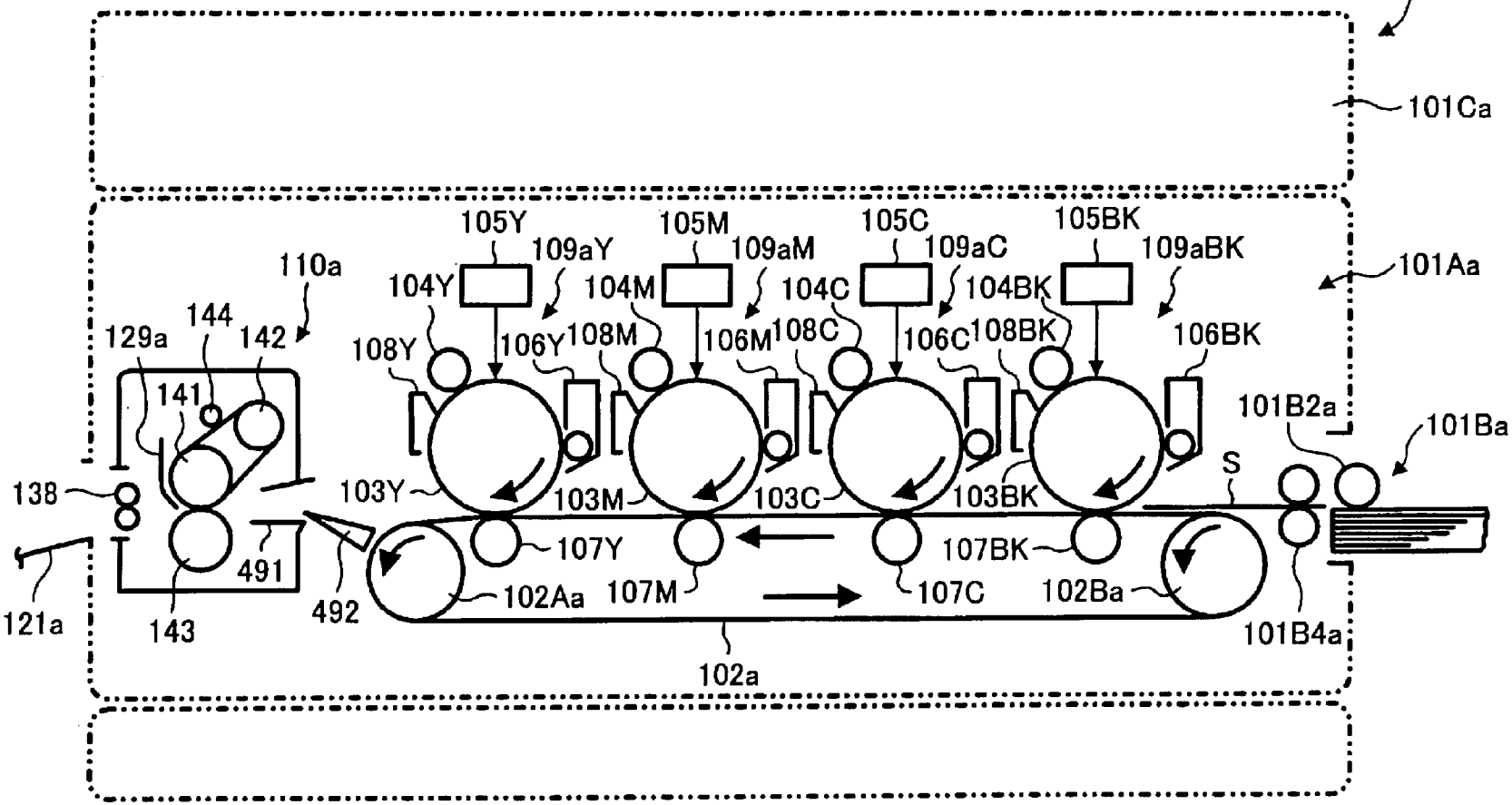
FIG. 20 is a schematic chart for illustrating a configuration of a color image forming apparatus including the fixing apparatus of the other embodiment of the present invention.

FIG. 20 illustrates still another embodiment of a color image forming apparatus 101*a* including a fixing apparatus. Such a color image forming apparatus may have substantially the same configuration to that illustrated in FIG. 14 except that intermediate transfer is omitted and direct transfer to the recording sheet S is performed.

The fixing apparatus 110*a* employed in the color copier 101*a* may now be described. The fixing apparatus 110*a* may be employed in the conventional color image forming apparatus 1*a* not coating silicone oil as release agent for the fixing belt 140 and instead using oil less toner. However, it may be applicable to a color printer, facsimile, and duplicator or the like, so that these apparatuses can improve marketable product performance as image forming apparatuses capable of credibly securing recording member separation performance if employing the fixing apparatus 110*a*.

Figure 21:
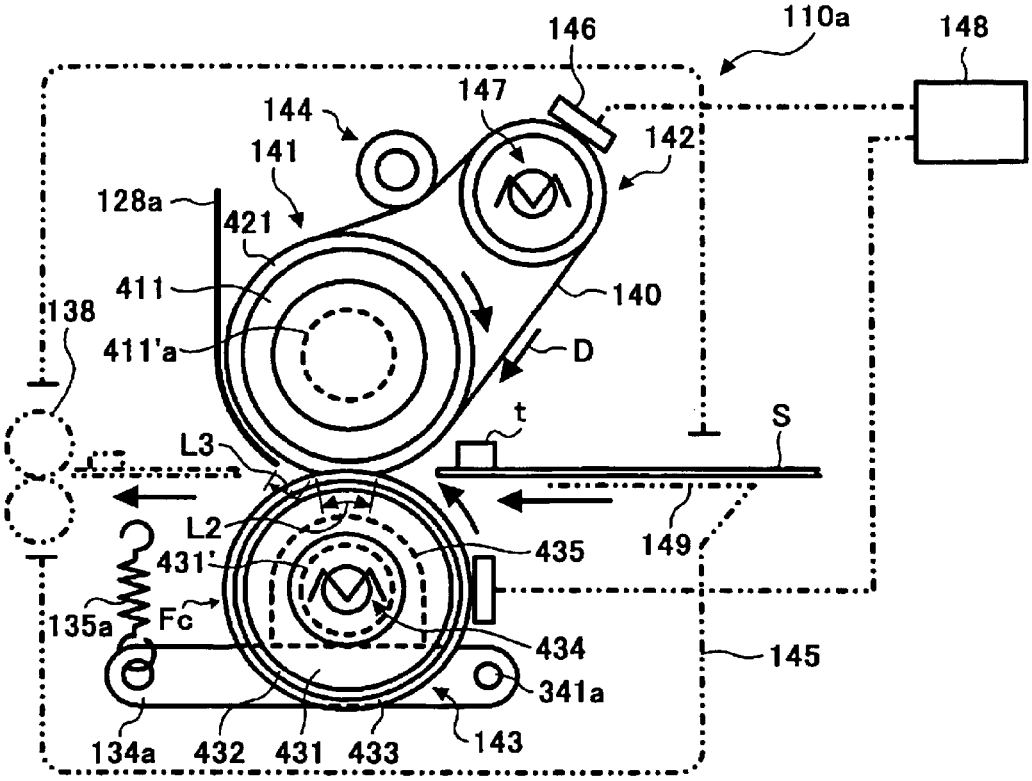
FIG. 21 is an enlarged schematic view for illustrating a fixing apparatus utilized in the color image forming apparatus of FIG. 20.

As illustrated in FIGS. 20 and 21, the image forming apparatus may include a fixing roller 141 and heating roller 142 serving as rotatable roller type fixing devices arranged oppositely to each the other, and an endless fixing belt 140 wound around these rollers. In addition, a pressure roller 143 having an endless pressure surface Fc and contacting the fixing belt 140 may be provided so as to form a nip N. A tension roller 144 may also be provided so as to apply tension to the fixing belt 140. In addition, a separation sheet 28*a* may be provided and oppositely arranged to the fixing belt 140. The fixing apparatus 110*a* may heat and rotate the fixing belt 40 with a heating roller 142 in a direction shown by an arrow D as illustrated in FIG. 21. Then, the fixing apparatus 110*a* may heat and fuse thereby fixing a not yet fixed toner image "t" carried on the recording sheet S" in the nip N. These rollers 131, 132, and 134 may be pivotally supported by a fixing apparatus use base frame 145 secured to a transfer unit U. Respective rotational shafts may be arranged in parallel.

A base material of the fixing belt 40 may be made of heat resistance plastic. For the heat resistance plastic, polyimede, polyamideimide, and polyetherketone (PEEK) may be employable. A thickness of the base material may preferably amount to about 30 to about 100 $\mu$m. Since the surface of the fixing belt 133 pressure contacts the non fixed toner image and recording sheet S, a surface layer having excellent releasability and heat resistance may be necessitated. Thus, a surface release layer 401 such as fluorine series plastic or the like (see FIG. 21) may be coated. Further, an elastic layer made of heat resistance rubber, such as silicone rubber, fluorine rubber, etc., having a thickness of from about 100 to 300 $\mu$m may be provided.

The heating roller 142 may be made of metal, such as AL, Fe, etc., having a diameter of from about 20 mm to 30 mm. The heating roller 142 may be a thin roller having a thickness (t) of from about 0.3 to 1.0 mm and include a halogen heater 147 inside thereof. Temperature of the heating roller 132 may be detected by a temperature control element 146. Detected temperature information may be output to an image processing section 148 so as to control the heating roller to fall within a prescribed set temperature range. Thereby, it may function to heat the fixing belt 140 up to a desirable temperature.

Further, the heating roller 142 may double as a tension roller, so that it may be suspended by a tension spring (not shown) in a direction as shown by an arrow P1 in the drawing. The fixing roller 141 may have a diameter of from 20 mm to 30 mm, and heat resistance elastic member 412 formed from heat resistance elastic member, such as form silicone rubber, liquid type silicone rubber, etc., may be provided so as to secure a nip width "L" on the outer circumference of the Fe core metal 411. Such an elastic layer 412 may have a thickness of from about 3 mm to about 6 mm. A surface hardness of the fixing roller 141 may be from about 30 to 50 degrees (Asker-C type).

The pressure roller 43 may be formed from a Fe or Al core metal 431 having a heat resistance elastic layer 432 such as fluorine series rubber, silicone rubber, etc., and a surface layer 343 formed from fluorine series plastic each coated on the core metal 431. In the current embodiment, to improve separation performance of a recording sheet carrying toner, a surface hardness of the pressure applying roller 143 may be larger that that of the fixing roller 141. Specifically, a nip for fixing use having a width L" may be formed between the fixing belt 142 and pressure applying roller 43 with it both ends being concave downwardly. In the current embodiment, a thickness of the elastic layer 432 of the pressure applying roller 143 may amount from about 0.5 to about 2 mm. Its surface hardness may be from about 70 to about 90 degrees (i.e. Hs: hardness spring)(Asker-C type). A halogen heater 434 may preferably be included inside the pressure-applying roller 143 so as to accelerate increasing in temperature of the pressure-applying roller.

The fixing apparatus 110*a* may include a rotation driving series (not shown) so as to transmit a rotation driving force to the pressure roller 143 via a transmission device (not shown). In addition to that, the rotation driving force can be transmitted to the fixing roller 141 in a certain case. Such a fixing apparatus 10*a* may hold a nip N formed from a section where the fixing belt 140 contacts and is wound around the fixing roller 141 to where the pressure roller 143 contacts with a width of L2. Thus, stable transfer and fixing performances may be obtained by decreasing image crush by the nip N.

A separation sheet 128*a* may be oppositely arranged to a separation surface of the fixing belt 140 winding and contacting the fixing roller 141. Such a separation sheet 128*a* may similarly be formed to that 128 of FIG. 14, and include a straight portion 282, a concave portion 283, and a tip portion 281. Similar to the separation sheet 128, the separation sheet 128*a* may be supported by a bracket 136 of a fixing apparatus use base frame 129 side via respective grooves of a pair of left and right guide members (See 304 of FIGS. 18A and 18B) pivotally supporting the fixing roller 141.

The tip portion 281 of the separation sheet 128*a* may be located at a position distanced from the exit end of the nip N formed between the fixing belt 140 winding and contacting the fixing roller 141 and the pressure applying roller 43 by a prescribed length L1. In addition, the tip portion 281 of the separation sheet 128*a* may be shape similarly to that 128 of FIG. 14. However, repetitious explanation therefor is omitted.

Also in this case and similar to the separation sheet 28 of FIG. 14, the gap L1 may be set smaller than the tip margin, and accordingly, the recording sheet may not wrap around the fixing roller. Specifically, the separation sheet 128*a* may relatively readily separate the recording sheet, and an ejection roller 138 may transfer and eject thereof onto an ejection tray 121.

Figure 22:
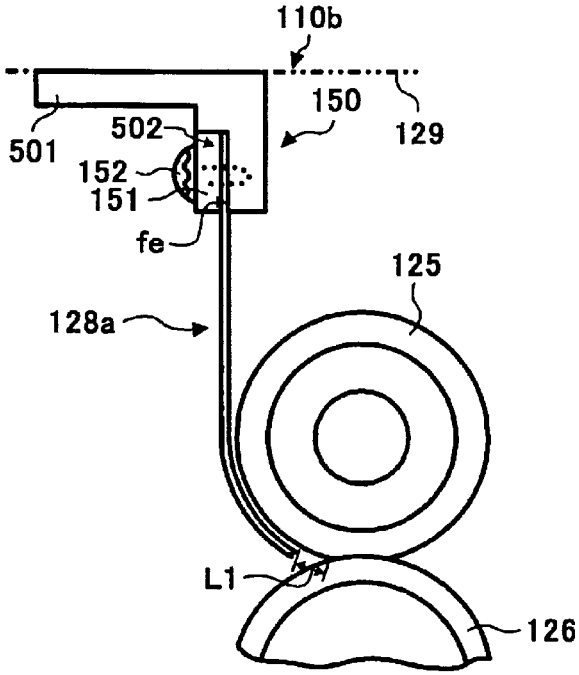
FIG. 22 is a side view for illustrating a relevant part configuration of an L-type bracket and separation sheet utilized in the fixing apparatus according to the present invention.
Figure 23:
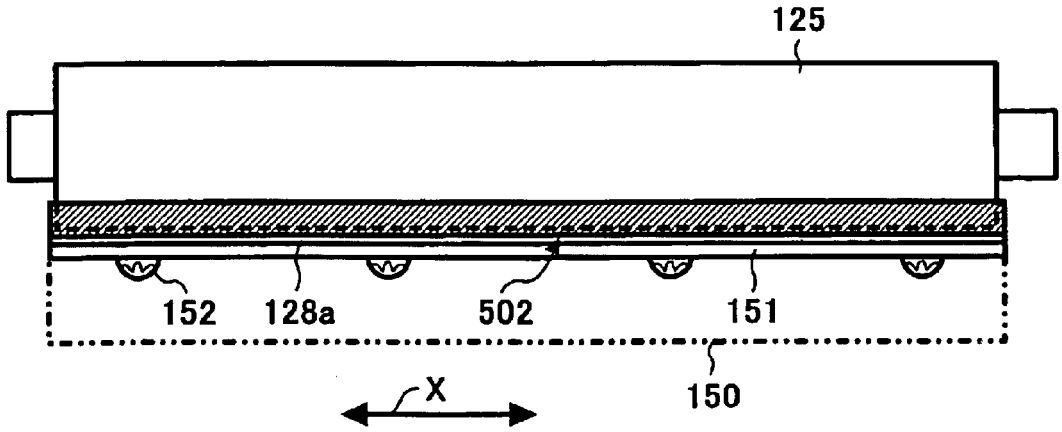
FIG. 23 is a plan view for illustrating a relevant part configuration of the fixing apparatus of FIG. 22.
Figure 24:
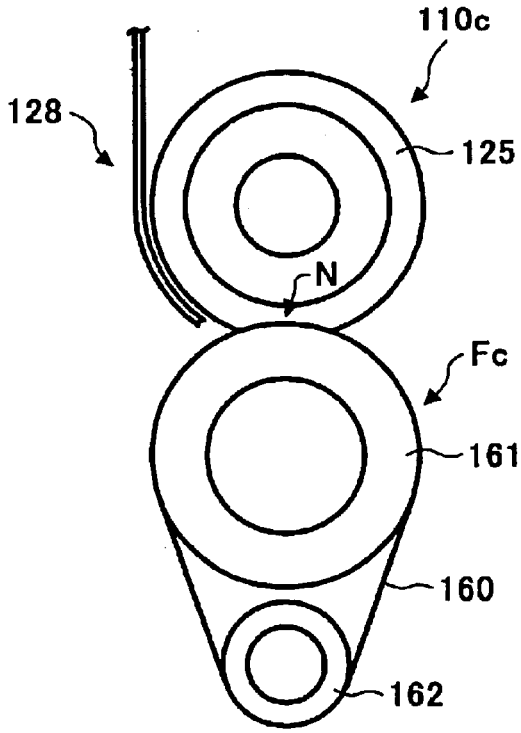
FIG. 24 is a side view for illustrating a relevant part configuration of a fixing roller and pressure-applying device utilized in the other embodiment.

The separation sheet 128*a* can be attached in a manner as illustrated in FIGS. 22 and 23. Specifically, an L-type bracket 150 having a similar length to a fixing roller 125 can be employed with its upper end connection portion 501 secured to a downward surface of the base frame 129 of a fixing apparatus 10*b* use. A concave sheet reception section 502 may continuously be provided in a longitudinal direction on its lower end. A surface "fe" capable of contacting an upper end of the separation sheet 128*a* may be formed on the sheet reception portion 502. The separation sheet 128*a* may be set on the surface "fe", and a plate 151 is laid thereon. Then, the upper end of the separation sheet 128*a* can be fastened to the sheet reception 502 via the plate 151 by a plurality of screws 52. Thus, the separation sheet 128*a* may credibly be supported. The similar function and effect can be obtained when the fixing apparatus 10*b* employing the L-type bracket 150 of FIGS. 22 and 23 is utilized.

The above-described embodiment can be employed in a mono-color image forming apparatus, facsimile, and printer or the like, and substantially the same function and effect can be obtained, obviously numerous additional modifications and variations of the present invention are possible in light of the above teachings. It is therefore to be understood that within the scope of the appended claims, the present invention may be practiced otherwise than as specifically described herein.

What is claimed is:

1. A fixing apparatus, comprising:

a fixing member configured to fix a toner image on a recording member with a heater;

a pressure contacting pressure contacting member configured to pressure contact the fixing member via the recording member and form a nip with the fixing member, said recording member being conveyed through the nip in such a manner that a toner image carried on the recording member contacts the fixing member in order for the toner image to be fixed with the heat and pressure, a tip margin of said recording member being directed toward the pressure contacting member side across a linear extension line drawn from a downstream end to upstream end of the nip when only the tip margin exits from the nip; and a fixing member side separation device configured to separate the recording member ejected from the nip from the fixing member, said fixing member side separation device being separately disposed from the surface of the fixing member, and a gap formed between the downstream end of the nip and the tip of the fixing member side separation device being set smaller than the width of the margin in a transfer direction.

2. The fixing apparatus according to claim 1, wherein a hardness of the surface of the pressure contacting member at the nip downstream end is larger than that of the nip downstream end of the fixing member.

3. The fixing apparatus according to claim 1, further comprising a pressure applying member side separation device contacting the surface of the pressure contacting member with its tip.

4. The fixing apparatus according to claim 1, further comprising a gap maintaining member configured to maintain a gap formed between the tip of the fixing member side separation device and the surface of the fixing member, said gap maintaining member being provided at respective tips of the fixing member side separation devices arranged in a direction perpendicular to the transfer direction contacting the surface of a transfer member non-passing area on the fixing member.

5. The fixing apparatus according to claim 1, wherein said fixing member side separation device is a single separation member type.

6. The fixing apparatus according to claim 5, wherein said fixing member side separation device includes an opening for ventilation.

7. The fixing apparatus according to claim 5, wherein said pressure contacting member side separation device includes an opening for ventilation.

8. The fixing apparatus according to claim 1, wherein said fixing member side separation device is formed from a sheet like separation member, and further comprising a tension applying member configured to bias the fixing member side separation device arranged in a direction perpendicular to the recording member transfer direction.

9. The fixing apparatus according to claim 1, wherein said pressure contacting member side separation device is formed from a sheet like separation member, and further comprising a tension applying member configured to bias the fixing member side separation device arranged in a direction perpendicular to the recording member transfer direction.

10. The fixing apparatus according to claim 1, wherein said toner image is formed by toner including at least plastic, colorant, and wax.

11. An image forming apparatus, comprising:

a toner image formation devices configure to form a toner image; and the fixing apparatus as claimed in claim 1.

12. A fixing apparatus, comprising:

a fixing member configured to fix a toner image on a recording member with a heater;

a pressure contacting member configured to pressure contact the fixing member via the recording member and form a nip with the fixing member, said recording member being conveyed through the nip in such a manner that a toner image carried on the recording member contacts the fixing member in order for the toner image to be fixed with the heat and pressure, a tip margin of said recording member being directed along a linear extension line drawn from a downstream end to upstream end of the nip when only the tip margin exits from the nip; and a fixing member side separation device configured to separate the recording member ejected from the nip from the fixing member, said fixing member side separation device being separately disposed from the surface of the fixing member, and a gap formed between the downstream end of the nip and the tip of the fixing member side separation device being set smaller than the width of the margin in a transfer direction.

13. A fixing apparatus, comprising:

a fixing member configured to fix a toner image on a recording member with a heater;

a pressure contacting member configured to pressure contact the fixing member via the recording member and form a nip with the fixing member, said recording member being conveyed through the nip in such a manner that a toner image carried on the recording member contacts the fixing member in order for the toner image to be fixed with the heat and pressure, a tip margin of said recording member being directed almost along a linear extension line drawn from a downstream end to upstream end of the nip when only the tip margin exits from the nip; and a pressure contacting member side separation device configured to separate the recording member ejected from the nip from the pressure contacting member, said pressure contacting member side separation device being separately disposed from the surface of the pressure contacting member, and a gap formed between the downstream end of the nip and the tip of the pressure contacting member side separation device being set smaller than the width of the margin in a transfer direction.

14. The fixing apparatus according to claim 13, further comprising gap maintaining members configured to maintain a gap formed between the tip of the pressure contacting member side separation device and the surface of the pressure contacting member, said gap maintaining members being provided on respective tips of the pressure contacting member side separation devices configured to contact the surface of a transfer member non-passing area on the pressure contacting member.

15. The fixing apparatus according to claim 13, wherein said pressure contacting member side separation device is a single separation member type.

16. A fixing apparatus, comprising:

a fixing member configured to fix a toner image on a recording member with a heater;

a pressure contacting member configured to pressure contact the fixing member via the recording member and form a nip with the fixing member, said recording member being conveyed through the nip in such a manner that a toner image carried on the recording member contacts the fixing member in order for the toner image to be fixed with the heat and pressure, a tip margin of said recording member being directed along a linear extension line drawn from a downstream end to upstream end of the nip when only the tip margin exits from the nip;

a fixing member side separation device configured to separate the recording member ejected from the nip from the fixing member, said fixing member side separation device being separately disposed from the surface of the fixing member, and a gap formed between the downstream end of the nip and the tip of the fixing member side separation device being set smaller than the width of the margin in a transfer direction, and a pressure contacting member side separation device configured to separate the recording member ejected from the nip from the pressure contacting member, said pressure contacting member side separation device being separately disposed from the surface of the pressure contacting member, and a gap formed between the downstream end of the nip and the tip of the pressure contacting member side separation device being set smaller than the width of the margin in a transfer direction.

17. The fixing apparatus according to claim 16, wherein a JIS-A hardness of the surface of the fixing member at the downstream end is substantially the same to that at the downstream end of the pressure contacting member.

18. A fixing apparatus, comprising:

a fixing member configured to fix a toner image on a recording member with a heater;

a pressure contacting member configured to pressure contact the fixing member via the recording member and form a nip with the fixing member, said recording member being conveyed through the nip in such a manner that a toner image carried on the recording member contacts the fixing member in order for the toner image to be fixed with the heat and pressure, a tip margin of said recording member being directed toward the fixing member side across a linear extension line drawn from a downstream end to upstream end of the nip when only the tip margin exits from the nip; and a pressure member side separation device configured to separate the recording member ejected from the nip from the pressure contacting member, said pressure member side separation device being separately disposed from the surface of the pressure contacting member, and a gap formed between the downstream end of the nip and the tip of the pressure member side separation device being set smaller than the width of the margin in a transfer direction.

19. The fixing apparatus according to claim 18, wherein a hardness of the surface of the fixing member at the downstream end is higher than that of the pressure contacting member at the downstream end.

20. The fixing apparatus according to claim 18, further comprising a fixing member side separation device contacting the surface of the fixing member with its tip.

21. A fixing apparatus, comprising:

a rotational fixing device including a roller section having a ring like elastic layer;

a release layer formed either by a ring like layer integrally formed on an outer circumferential surface of the roller section or an endless belt separately wound around the roller section;

a heat source configured to generate heat;

a pressure applying device configured to pressure contact the rotational fixing device via a recording sheet having a non fixed toner image with its endless pressure applying surface, said non-fixed toner image being fixed in a nip formed between the rotational fixing device and the pressure applying device; and a separation sheet configured to separate the recording sheet carrying the toner image from the release layer, said separation sheet being disposed in the vicinity of an exit of the nip, and said separation sheet is attached to the release layer and separated from the release layer by a prescribed gap while maintaining a curvature substantially along the outer diameter shape of the release layer configured to engage and rotate together with the roller section.

22. The fixing apparatus according to claim 21, wherein said rotational fixing device is formed from a fixing roller having a core metal, a heater disposed within the core metal, and at least elastic and release layers overlaid on the outer circumferential surface of the core metal.

23. An image forming apparatus, comprising:

a toner image formation device configured to form a toner image with an electro-photographic system; and the fixing apparatus as claimed in claim 22.

24. The fixing apparatus according to claim 21, wherein said rotational fixing device comprises:

a roller section having a core metal;

an elastic layer wound around the core metal;

a heating roller oppositely arranged to the roller section said heating roller including a heater; and an endless belt wound around the rollers.

25. The fixing apparatus according to claim 21, wherein said pressure applying device includes a pressure applying roller having elastic and release layers.

26. The fixing apparatus according to claim 21, wherein a gap between the tip of the separation sheet and the exit of the nip is either substantially the same or less than a tip margin of the recording sheet.

27. The fixing apparatus according to claim 21, wherein a ridge, facing in the vicinity of the release layer, of the separation sheet is sharply tapered.

28. The fixing apparatus according to claim 27, wherein a surface roughness of the ridge facing the release layer is less than 0.2 $\mu$m (Ra).

29. A fixing apparatus, comprising:

a heat roller including a heater;

a fixing roller including a core metal and an elastic layer coated on the circumferential surface of the core metal and configured to fix a toner image carried on a recording member;

a fixing belt wound around the heating and fixing rollers, said fixing belt including a release layer;

a pressure roller configured to pressure contact the fixing roller via the fixing belt, said pressure roller having a core metal and elastic and release layers on the circumferential surface of the core metal, said pressure roller forming a nip configured to apply heat and pressure so as to fix the toner image to the recording member with the fixing roller; and a separation sheet configured to separate the recording sheet from the fixing roller, said separation sheet being disposed in the vicinity of an exit of the nip and is approximated to the fixing roller with a prescribed gap while maintaining a prescribed curvature substantially along the outer shape of the fixing roller.

30. A fixing apparatus, comprising:

fixing means for fixing a toner image on a recording member with heating means;

pressure contacting means for pressure contacting the fixing means via the recording member, said pressure contacting means forming a nip with the fixing means, said recording member being conveyed through the nip in such a manner that a toner image carried on the recording member contacts the fixing means in order for the toner image to be fixed with the heat and pressure, a tip margin of said recording member being directed along a linear extension line drawn from a downstream end to upstream end of the nip when only the tip margin exits from the nip;

fixing member side separating means for separating the recording member ejected from the nip from the fixing means, said fixing means side separating means being separately disposed from the surface of the fixing means, and a gap formed between the downstream end of the nip and the tip of the fixing means side separating means being set smaller than the width of the margin in a transfer direction, and pressure contacting means side separating means for separating the recording member ejected from the nip from the pressure contacting means, said pressure contacting means side separating means being separately disposed from the surface of the pressure contacting means, and a gap formed between the downstream end of the nip and the tip of the pressure contacting means side separating means being set smaller than the width of the margin in a transfer direction.

31. A fixing method, comprising the steps of:

providing a fixing member configured to fix a toner image on a recording member with a heater;

providing a pressure contacting member configured to pressure contact the fixing member via the recording member and form a nip with the fixing member, said recording member being conveyed through the nip in such a manner that a toner image carried on the recording member contacts the fixing member in order for the toner image to be fixed with the heat and pressure, a tip margin of said recording member being directed along a linear extension line drawn from a downstream end to upstream end of the nip when only the tip margin exits from the nip;

providing a fixing member side separation device configured to separate the recording member ejected from the nip from the fixing member, said fixing member side separation device being separately disposed from the surface of the fixing member, and a gap formed between the downstream end of the nip and the tip of the fixing member side separation device being set smaller than the width of the margin in a transfer direction, and providing a pressure contacting member side separation device configured to separate the recording member ejected from the nip from the pressure contacting member, said pressure contacting member side separation device being separately disposed from the surface of the pressure contacting member, and a gap formed between the downstream end of the nip and the tip of the pressure contacting member side separation device being set smaller than the width of the margin in a transfer direction.

* * * * *